US007184698B2

(12) United States Patent
Tombs

(10) Patent No.: US 7,184,698 B2
(45) Date of Patent: Feb. 27, 2007

(54) DURABLE ELECTROPHOTOGRAPHIC PRINTS

(75) Inventor: Thomas N. Tombs, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 147 days.

(21) Appl. No.: 11/076,843

(22) Filed: Mar. 10, 2005

(65) Prior Publication Data

US 2005/0207807 A1 Sep. 22, 2005

Related U.S. Application Data

(60) Provisional application No. 60/553,740, filed on Mar. 17, 2004.

(51) Int. Cl.
*G03G 15/20* (2006.01)

(52) U.S. Cl. ..... 399/341

(58) Field of Classification Search ..... 219/216; 399/328, 341

See application file for complete search history.

(56) References Cited

U.S. PATENT DOCUMENTS

| | | | | |
|---|---|---|---|---|
| 3,948,215 | A | 4/1976 | Namiki | |
| 5,234,783 | A | 8/1993 | Ng | |
| 5,256,507 | A | 10/1993 | Aslam et al. | |
| 5,506,671 | A | 4/1996 | Buts et al. | |
| 5,842,099 | A | 11/1998 | Aslam et al. | |
| 5,887,234 | A | 3/1999 | Aslam et al. | |
| 5,890,032 | A | 3/1999 | Aslam et al. | |
| 5,897,249 | A | 4/1999 | Aslam et al. | |
| 5,905,012 | A | 5/1999 | DeMeutter et al. | |
| 5,926,679 | A | 7/1999 | May et al. | |
| 6,026,274 | A | 2/2000 | Aslam et al. | |
| 6,167,224 | A | 12/2000 | Dalal | |
| 6,203,953 | B1 | 3/2001 | Dalal | |
| 6,352,806 | B1 | 3/2002 | Dalal | |
| 6,535,712 | B2 | 3/2003 | Richards | |
| 6,587,665 | B2 | 7/2003 | Bartscher et al. | |
| 6,594,465 | B2 | 7/2003 | Rohde et al. | |
| 6,608,987 | B2 | 8/2003 | Bartscher et al. | |
| 6,661,993 | B2 * | 12/2003 | Bartscher et al. | 399/341 |
| 6,678,493 | B2 | 1/2004 | Maeyama et al. | |
| 6,880,463 | B2 * | 4/2005 | De Meulemeester et al. | 101/488 |

OTHER PUBLICATIONS

Detlef Schulze-Hagenest, et al., "UV-cured Toners for Printing and Coating on Paper-like Substrates", 1997 International Conference on Digital Printing Technologies, pp. 168-172.

* cited by examiner

*Primary Examiner*—Hoang Ngo
(74) *Attorney, Agent, or Firm*—Carl F. Ruoff

(57) ABSTRACT

UV-glossing for simplex and duplex prints, wherein an input member having thereon a pre-gloss toner image including UV-curable toner is moved, in non-slip association with a smooth UV-transparent web, jointly with the web through a plurality of process zones sequentially including a heating zone and an exposure zone, thereby producing an output member having a glossed, UV-cured, surface. In the heating zone, at least the outermost toner of the pre-gloss toner image is heated to a molten state in contact with the web. In the exposure zone, with the molten state being maintained, at least the outermost toner which contacts the web is cured by a flux of UV radiation transmitted through the web. In a preferred embodiment, the UV-curable toner is formed as an outer layer on the pre-gloss toner image.

19 Claims, 7 Drawing Sheets

DURABLE ELECTROPHOTOGRAPHIC PRINTS

CROSS REFERENCE TO RELATED APPLICATIONS

This is a 111A application of Provisional Application Ser. No. 60/553,740, filed Mar. 17, 2004.

FIELD OF THE INVENTION

The invention relates to electrophotography and to toner fusing apparatus, and in particular to belt fusing apparatus and method wherein toner in a molten state is UV-cured to produce durable toner images on receiver members.

BACKGROUND OF THE INVENTION

In an electrophotographic apparatus, e.g., a reproduction or printing machine, unfused toner images are formed on receiver members, and the toner images are then fused or fixed to receiver members in a fusing station employing heat and/or pressure. The receiver members are typically sheets of paper or transparency stock. The resulting output prints can be simplex (image on one side only) or duplex. A duplex print can be made by forming an unfused toner image on one side of a receiver member, fusing it, then forming an unfused toner image on the other side of the receiver member and fusing once again. Alternatively, an unfused image can be formed on each side of a receiver member and the toner images on both sides of the receiver member fused simultaneously in the fusing station so as to form a duplex print.

For full color high quality electrophotographic printing, it is known to employ a modular machine typically including, for example, at least four modules arranged in tandem fashion. In a 4-module machine, each module produces a respective single color toner separation image, e.g., a cyan, magenta, yellow, or black toner image. A receiver member is moved successively through the modules such that the respective single color toner images are sequentially transferred in registry to the receiver member. The receiver member can be electrostatically adhered to a transport belt, which transports the receiver member through the modules. Each module can include a primary imaging roller (imaging cylinder) and a compliant intermediate transfer member (blanket cylinder), as employed for example in the commercially available NexPress 2100 Digital Color Printer (NexPress Solutions LLC of Rochester, N.Y.).

Color prints made by electrophotographic reproduction apparatus, especially high gloss prints, can be subject to damage by a customer, e.g., by rubbing, abrasion, or scratching. This is particularly the case for high quality glossy photographic prints made from very small toner particles, for which the high quality can be compromised quite easily because the toner layers are comparatively thin and therefore more readily damaged. Moreover, a fused toner image on a receiver member can suffer from cracking damage when the print is bent. Hence there is a need to provide photographic quality prints which are more durable and resistant to the above-mentioned types of damage. In certain instances a print can be subject to fading, e.g., via exposure to ambient light which typically contains a UV component, and in such cases it is desirable to include in the printed image a UV-absorbing overcoat.

A common feature of electrophotographically produced color prints is a phenomenon known as "differential gloss", whereby for example different areas within a pictorial image exhibit varying amounts of gloss. "Differential gloss" may encompass regions of high gloss and relatively low gloss, or even regions having little or no gloss. Customers tend to prefer uniformly glossed pictorial images. Equipment for making glossy toner images is known, and the degree of gloss or gloss level of a toner image can be quantitatively measured in a standard fashion using a specular glossmeter. Typically, a single reflectivity measurement is made which measures the amount of light from a standard source which is specularly reflected in a defined path. A suitable device for this purpose is a Glossgard II 20° glossmeter (available commercially from Pacific Scientific Inc., Silver Springs, Md.) which produces a reading, on a standardized scale, of a specularly reflected beam of light having angles of incidence and reflection of 20° to the normal. The glossmeter can measure gloss levels representing a dull matte to a very shiny finish. The usual range of measured gloss numbers on the meter is between 0 and 100, the instrument being normally calibrated or adjusted so that the upper limit corresponds to a surface that has substantially less than the complete specular reflection of a true mirror. Thus extremely smooth glossy surfaces can have gloss levels in excess of 100. Reflectivity readings are indicated as $G_{20}$ gloss numbers (gloss levels). The larger the $G_{20}$ number, the glossier the toner image.

For certain gloss measurements, for example of coatings, a glossmeter may be used in which the specularly reflected beam of light has angles of incidence and reflection of 60° to the normal, i.e., giving $G_{60}$ numbers. The larger the $G_{60}$ number, the glossier is the surface being measured.

It is known to make glossy electrophotographic prints via a number of methods utilizing various types of apparatus. Gloss can be imparted as a result of the fusing of toner particles in a fusing station, and in certain fusing equipment it is possible to control the amount of gloss. A belt fusing apparatus has been shown to be especially useful in this regard. In general, a belt fusing apparatus can include a heated roller, a steering roller of relatively smaller diameter, and a belt in tension around both heated roller and steering roller, with the belt passing through a pressure nip formed between the heated roller and a pressure roller. A hard heated roller and a compliant or resilient pressure roller can be used effectively for the belt fusing apparatus. Alternatively, a resilient heated roller can be used with a hard pressure roller. The heated roller is typically heated from within, e.g., by a lamp, although an externally heated roller can be used instead. A receiver member carrying a toner image for glossing is passed through the fusing nip with the toner facing the belt, and after leaving the nip the receiver member can be cooled while adhered to the belt via the adhesive properties of the toner. The receiver member can then be transported on the belt to the steering roller, whereupon the cooled receiver member can disengage from the belt, for example, as a result of the inherent stiffness of the receiver and a small radius of curvature of the steering roller.

The Namiki patent (U.S. Pat. No. 3,948,215) discloses a technique for providing gloss by fusing a toner image on a receiver by heat and pressure from a heatable surface in contact with the toner of the image. After fusing, the toner image is cooled while remaining in contact with the heatable surface. The receiver with the fused image is subsequently separated from the heatable surface without incurring the disadvantageous phenomenon of offset, i.e., in which a certain amount of toner material remains on the heatable surface after separation of the receiver therefrom.

In the Aslam, et al. patent (U.S. Pat. No. 5,256,507), a method of fusing a toner pattern to a receiver member is disclosed using a belt fusing apparatus, the toner pattern including at least one toner image for providing a low gloss and at least one toner image for providing a high gloss. The belt fusing apparatus includes a heated roller, a steering roller, and a fusing belt entrained around both rollers, with the fusing belt passing through a pressure nip formed between the heated roller and a pressure roller. The toner pattern on the receiver member is fused in the nip with the toner pattern facing the heated roller. In consequence of adhesive forces acting between the receiver member and the fused toner and between the toner and the belt, the receiver member is thereby transported from the nip through a cooling zone located between the heated roller and the steering roller such that the toner pattern cools while in contact with the belt. The receiver is separated from the belt as the belt passes around the steering roller, with the toner having been cooled in an airflow to a temperature at which offset does not occur. It is advantageous that the fusing of the toner image and the separation of the receiver member from the fusing apparatus are separate events.

The Aslam, et al. patent (U.S. Pat. No. 5,890,032) discloses a fusing accessory or glossing unit for use in conjunction with a reproduction apparatus (See also the Aslam, et al. patent (U.S. Pat. No. 6,026,274). In a conventional fusing mode within the reproduction apparatus, toner images on receiver members can be fused "in-line" using any suitable fusing mechanism. Alternatively, in a "parallel-line" fusing mode, toner images can be shunted through an attached glossing unit for fusing therein using a belt fuser arrangement for the controllable glossing of toner images. As another alternative, the fusing accessory can be employed as a stand-alone glossing unit for "off-line" glossing, i.e., with the accessory physically separated from the reproduction apparatus. For "off-line" glossing, fused prints such as pictorial prints produced by the conventional fusing are finished in the glosser accessory, e.g., loaded manually therein for glossing. The belt fuser arrangement of the glosser unit of U.S. Pat. No. 5,890,032 differs somewhat from that disclosed in the above-cited U.S. Pat. No. 5,256,507 in that in conjunction with use of a post-nip wrap of the belt on the heated roller, the degree or amount of glossing is controlled by controlling the amount of heat delivered per unit area per unit time in the fusing nip of the glosser.

An "in-line" belt fusing apparatus for controllable glossing, having a similarity to that of the belt fusing apparatus used in the glosser accessory of U.S. Pat. No. 5,890,032, is disclosed in the Aslam, et al. patent (U.S. Pat. No. 5,897,249).

The Aslam, et al. patents (U.S. Pat. Nos. 5,256,507, 5,890,032, 5,897,249) are hereby incorporated by reference.

The Kabashima patent (U.S. Pat. No. 6,512,914) discloses a glossing unit which is selectably attachable to a reproduction machine. The glossing unit includes a belt fusing apparatus for providing gloss to prints previously fused via conventional fusing in the reproduction machine. Prints are optionally sent to the glossing unit by diversion thereto from a path leading to an exit from the machine. After glossing, a print is moved to rejoin the path to the exit.

The Rohde, et al. patent (U.S. Pat. No. 6,594,465) and the Bartscher, et al. patent (U.S. Pat. No. 6,587,665) disclose apparatus and methods for delivering UV radiation to a toner image on a substrate for purpose of fusing the toner image to the substrate.

The Bartscher, et al. patent (U.S. Pat. No. 6,608,987) discloses method and apparatus for controlling a degree of luster of a toner layer or of a toner image fused to a substrate, especially cardboard or paper. Toner particles are used having a composition crosslinkable by UV radiation. The crosslinking or curing is carried out with the crosslinkable toner particles heated to an elevated temperature, notably above the glass transition temperature. The heating is carried out via IR radiation, the heating being done in a separate step prior to crosslinking the heated toner via UV radiation from a UV source. Thus the fixing of the toner to the substrate effectively combines contactless (radiant) fusing with UV curing such that the melting process and the curing process are independently controllable. A desired degree of luster can be obtained by controlling, e.g., via feedback, one or more of the variables of: pre-cure temperature, time for the crosslinking reaction, and UV power delivered per unit area. The toner layer on the substrate includes at least one UV-curable toner and can include toners of different colors.

Schulze-Hagenest, et al., in *UV-cured Toners for Printing and Coating on Paper-like Substrates*, 13th International Conference on Digital Printing Technologies (Imaging Science and Technology, 1997) pp. 168–172, disclose UV-curable toners for use to form durable prints on paper and cardboard substrates. Also described is apparatus for the UV curing (crosslinking) of such UV-curable toners at elevated temperatures, i.e., above the glass transition temperature ($T_g$) of the toner. A radiant fusing step, using IR radiation to heat the toner, is followed by a separate UV curing step in which the toner is in a molten or quasi-molten state. The IR pre-fusing provides a smooth film, while the subsequent UV curing reaction is very rapid. A curing temperature between approximately 70 C–80 C was sufficient, well above the Tg of the UV-crosslinkable toner. Schulze-Hagenest, et al. demonstrated the UV-curing of a thin IR-melted clear toner layer formed via magnetic brush development on a cardboard substrate (average toner thickness of 7.5 μm using 10.8 μm diam. toner particles). The process speed past a UV lamp was 10 cm/sec using a UV power density of about 1 Joule/cm$^2$. The UV-crosslinkable toner was made using a polyester resin (830 parts w/w), a crosslinker (170 parts w/w), a photoinitiator (10 parts w/w) and a flowing agent (6 parts w/w), i.e., with a photoinitiator (sensitizer) doping of about 1.0% w/w. The process speed of 10 cm/sec was much lower than that typically used in a high speed electrophotographic color printer. However, it is stated that up to 3% w/w of sensitizer can be used.

UV-crosslinkable toner formulations are disclosed in the above-cited Bartscher, et al. patent (U.S. Pat. No. 6,608,987) and in the De Meutter, et al. patent (U.S. Pat. No. 5,905,012).

The May, et al. patent (U.S. Pat. No. 5,926,679) discloses that a clear (non-marking) toner layer can be laid down on a photoconductive member (e.g., imaging cylinder) prior to forming a marking particle toner image thereon, and that a clear toner layer can be laid down as a last layer on top of a marking particle toner image prior to transfer of the image to an intermediate transfer member (e.g., blanket cylinder). It is also disclosed that a clear toner layer can be laid down on a blanket cylinder prior to transferring a marking particle toner image from a photoconductive member thereon.

The use of transparent layers of toner particles in association with toner images for providing gloss for the fused images on receiver members is disclosed for example in the Ng patent (U.S. Pat. No. 5,234,783), the Buts, et al. patent (U.S. Pat. No. 5,506,671), the Aslam, et al. patent (U.S. Pat. No. 5,842,099), the Dalal patents (U.S. Pat. Nos. 6,167,224, 6,203,953, and 6,352,806), the Richards patent (U.S. Pat. No. 6,535,712) and the Maeyama, et al. patent (U.S. Pat. No. 6,678,493).

In the Aslam, et al. patent (U.S. Pat. No. 5,887,234), a reproduction machine including conventional fusing apparatus and a glosser fusing apparatus is disclosed in what may be called a "parallel-line" arrangement. The glosser fusing apparatus, which is a belt fusing apparatus, is selectable for making glossy output prints, i.e., is employed as alternative to the conventional fusing apparatus. The reproduction machine includes an intermediate transfer roller upon which a development station can form a layer of colorless toner when the glosser fusing apparatus is selected. An unfused multicolor toner image is built up in juxtaposition with the colorless toner layer, whereupon the colorless toner plus multicolor toner image are co-transferred to a receiver member and fused thereon in the glosser fusing apparatus. When glossing is not needed, the colorless toner layer is not deposited on the intermediate transfer roller, and an unfused multicolor toner image on the intermediate transfer roller is transferred to a receiver sheet which is sent to the conventional fusing apparatus.

SUMMARY OF THE INVENTION

The subject invention provides a way of glossing and crosslinking toner via contact which provides an alternative to the non-contact method of the Bartscher, et al. patent (U.S. Pat. No. 6,608,987) for forming glossed, crosslinked toner images. The present invention is particularly adapted to making crosslinked, glossy, electrophotographic, toner images of photographic quality in which "differential gloss" is substantially absent, and it is an object of the invention to produce durable pictorial color prints having a substantially uniform gloss in pictorial areas.

The subject invention is a glossing apparatus for UV-crosslinking and glossing a toner image on a receiver member. The glossing apparatus employs direct contact between a UV-curable toner and a smooth UV-transparent movable web, the glossing apparatus incorporating a plurality of processing zones including: a heating zone for melting UV-curable toner under pressure, an exposure zone for curing melted UV-curable toner via UV radiation, a cooling zone, and a separation zone for separating UV-cured glossed toner images from the web. The glossing apparatus can provide a durable surface on an output member having a substantially uniform gloss, e.g., in a pictorial area.

The UV-curable toner is included in a pre-gloss toner image carried by an input member for the glossing apparatus. A pre-gloss toner image preferably includes a color toner image formed on a receiver member using any suitable electrostatographic technique. In at least a portion of the pre-gloss toner image, at least the outermost surface particles are UV-curable toner particles, preferably colorless UV-curable toner particles. In all aspects of the invention, an input member having UV-curable toner in contact with the web is moved in non-slip association with the web through the heating zone of the glossing apparatus so as to fuse or melt, preferably under applied pressure, at least UV-curable toner in contact with the web. After leaving the heating zone, and with at least the UV-curable toner in contact with the web remaining in a molten state, the receiver member is transported jointly with the moving web through the exposure zone, wherein exposure to UV radiation is given through the web so as to cure, preferably via crosslinking, at least the UV-curable toner which is in contact with the web. The receiver member is then moved jointly with the web into the cooling zone such that any UV-curable toner of the pre-gloss toner image is cooled below the corresponding glass transition temperature. Following cooling, the receiver member having the cured toner image adhered thereon is separated from the web in the separation zone. A resulting output member, i.e., a crosslinked glossed print, has in the glossed area a gloss characteristic that is primarily determined by the surface smoothness of the web. A high-gloss, tough, crosslinked, color toner image can be produced which has superior resistance to cracking, abrasion, and scratching. A feature of the invention is that the heating (fusing), curing, cooling, and separation from the web are preferably separate, sequential, events.

To produce a duplex glossed print, a receiver member having a cured glossed image on one face can be reprocessed inside the glossing apparatus. For example, with a new pre-gloss toner image formed on the opposite face of the receiver member, the receiver member is re-passed through the glossing apparatus (with UV-curable toner of the new pre-gloss toner image contacting the web). Thus each face of a resulting output duplex print can have a UV-cured glossed toner image thereon. Moreover, an output duplex "mixed" print can be made having one face entirely non-glossed, with the opposite face having thereon a UV-glossed image, e.g., a pictorial image.

In a preferred embodiment of the present invention, the web is included as a movable, closed loop, smooth, belt in a belt fusing glossing apparatus. This glossing apparatus includes a UV radiation source for crosslinking or curing UV-crosslinkable toner via transmission of UV radiation through the belt. In general, an input member to be processed in the glossing apparatus of the invention carries a pre-gloss toner image formed on a receiver member, the pre-gloss toner image including UV-crosslinkable toner. A pre-gloss toner image includes non-glossed marking toner contained in a toner image electrophotographically formed on the receiver member in any suitable engine. Toner that is designated herein as non-glossed has not been processed using a dedicated glossing mechanism or apparatus. A non-glossed toner image can in certain instances have a certain glossiness. Thus a non-glossed toner image can exhibit a phenomenon known as differential gloss, i.e., can have certain portions which are glossier than other portions, and can include matte or low gloss portions. Non-glossed toner included in the pre-gloss toner image may have been fused, e.g., in a conventional fusing apparatus, with a resulting differential gloss. Alternatively, the non-glossed toner can be unfused, and therefore exhibit little or no gloss. The non-glossed toner is generally color toner, typically including one or more of cyan, magenta, yellow, and black toner, but not limited to these colors. Furthermore, any colorless UV-crosslinkable toner included in the pre-gloss toner image is a non-glossed toner. The pre-gloss toner image generally includes at least one pictorial or color area. The pre-gloss toner image can further include at least one non-pictorial area, e.g., a text area. A pictorial area of a pre-gloss toner image is generally a suitable area for glossing according to the present invention. In a non-pictorial area, UV-curable toner can be omitted, under certain circumstances. UV-curable toner can also be laid down in a non-uniform layer over the pregloss toner image (both pictorial and non-pictorial area) in order to level the toner image.

The heating zone in the preferred embodiment is provided by a heated fusing nip, and after passage of the pre-gloss toner image through the heated nip such that UV-crosslinkable toner is in direct contact with the smooth belt, a crosslinking UV exposure is transmitted through the belt while the UV-crosslikable toner is in a molten state. The pre-gloss toner image preferably includes a preferably colorless UV-crosslinkable toner formed as a layer in juxtaposition with the non-glossed (color) toner image. Thus a preferred output member produced by the glossing apparatus, and separated from the belt, has a preferably colorless, crosslinked, outer surface, which outer surface exhibits little or no differential gloss in pictorial areas or across the entire outer surface.

In an important aspect of the invention, a UV-glossing apparatus is included within an electrophotographic reproduction apparatus. In one embodiment, the UV-glossing apparatus is an alternative fusing device in the reproduction apparatus. In this embodiment, a conventional color toner image made in the reproduction apparatus and selected for glossing is unfused prior to forming thereon the UV-crosslikable toner layer so as to produce an unfused pre-gloss toner image. The UV-glossing apparatus is preferably incorporated in "parallel-line" fashion, such that unfused toner images included in a job selected for glossing can be shunted to the UV-glossing apparatus for fusing and glossing therein (the UV-glossing apparatus is also the primary fusing apparatus for glossed toner images in this embodiment). An output member in the form of a glossed cured simplex print can leave the UV-glossing apparatus and be outputted directly from the reproduction apparatus. A duplex print which is glossy on both sides can be made by recycling the simplex print through the reproduction apparatus, i.e., making an unfused color toner image on the reverse side of the print and then re-shunting the print through the UV-glossing apparatus so as to make a glossed cured duplex print, which is then outputted from the reproduction apparatus. On the other hand, for standard simplex and duplex jobs not requiring the glossing apparatus, toner images are made without the colorless toner layer and moved for fusing through a conventional "in-line" fusing station located within the reproduction apparatus. In other embodiments, the UV-glossing apparatus, which is included as a "parallel-line" device, does not act as a primary fusing device for glossed images, and a pre-gloss toner image includes color toners fused in a fusing station within the reproduction apparatus prior to sending the pre-gloss toner image to the glossing device. For standard simplex and duplex jobs not requiring the glossing apparatus, toner images made without the colorless toner layer are fused and outputted (by-passing the glossing apparatus).

In an another aspect of the invention, a simplex or duplex fused color toner image is made conventionally in an electrophotographic reproduction apparatus, and the resulting print moved to an accessory unit containing UV-glossing equipment of the invention. The accessory unit can be a stand-alone, or "off-line", unit. In an embodiment, the accessory unit further includes a laydown mechanism for depositing crosslinkable colorless toner on a pre-fused color image. For simplex glossing in the accessory unit, a simplex fused color toner image on the receiver member is coated in the accessory unit by a UV-crosslinkable toner layer so as to form a pre-gloss toner image. The pre-gloss toner image then moves to the glossing apparatus wherein re-fusing plus crosslinking provides a durable, glossy, output print. For duplex glossing, a pre-fused duplex color print made in the electrophotographic machine is moved twice through the laydown mechanism plus UV-glossing apparatus. A second (duplexing) pass through the accessory unit can be done manually by turning over the output member and re-feeding it, or alternatively the output image can be inverted in the accessory and returned via a mechanical mechanism for the re-feeding.

In an alternative embodiment in an accessory unit, a UV-crosslinkable toner layer is laid down on an unfused simplex color toner image in the electrophotographic reproduction apparatus and the receiver member passed through a conventional fusing station therein so as to form a pre-gloss toner image for sending to the accessory unit for glossing via re-fusing and UV-curing. For duplex, a fused image inclusive of the UV-crosslinkable toner overlayer is formed on both sides of the receiver before the receiver is sent to the accessory unit. A second (duplexing) pass through the glossing apparatus can be done manually by turning over the output member and re-feeding it, or alternatively the output image can be inverted in the accessory and returned via a mechanical mechanism for the re-feeding. In a variation, the UV-crosslinkable toner layer can be deposited on the fused color toner image(s) in the electrophotographic reproduction apparatus and subsequently "tacked" in the machine to the fused image(s), e.g., via infrared radiation or other suitable means, after which the receiver carrying the pre-gloss toner image(s) is sent to the accessory unit for simplex or duplex UV-glossing.

In yet another aspect of the invention, for both simplex and duplex, no colorless toner particles are used to form a pre-gloss color toner image, i.e., at least one and preferably all of the color toners used for making pre-gloss color toner images are UV crosslinkable.

In still yet another aspect of the invention, UV-glossing can be selectively carried out on a portion of the maximum (full-page) image area on a receiver member, e.g., in a pictorial portion in which UV-curable toner is selectively included (such as for example by electrophotographic deposition of a colorless UV-curable toner overlayer on a partial-page conventional color toner pattern). Thus a resulting print will be glossed by the glossing apparatus in the pictorial area, and substantially non-glossed in a non-pictorial area (such as a text area) where UV-curable toner is absent.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Apparatus and method are disclosed for making high quality electrophotographic color prints having tough, glossy, surfaces. The subject invention, for crosslinking and glossing a toner image on a receiver member, provides method and apparatus alternative to that disclosed in the Bartscher, et al. patent (U.S. Pat. No. 6,608,987). Rather than glossing via a contactless method, the invention employs direct contact between UV-curable toner and a smooth UV-transparent web, the web movable in a glossing apparatus which includes a heating zone for melting the UV-curable toner as well as an exposure zone for curing, via transmission of UV radiation through the web, melted UV-curable toner in contact with the web.

The present invention differs from that disclosed in U.S. Pat. No. 6,608,987, in that the degree of luster or gloss is not primarily controlled by controlling a radiation intensity or a UV radiation dose per unit area of a toner image. The degree of luster, i.e., the amount of image gloss, is determined primarily by the smoothness of the belt surface of the fusing belt in intimate contact with the molten UV-curable toner as it is exposed to, and crosslinked by, UV radiation and subsequently cooled thereon. In common with the disclosure of U.S. Pat. No. 6,608,987, the subject invention uses a process in which fusing of UV-curable toner and crosslinking are carried out consecutively. The main objectives of the invention are to provide, especially for photographic quality printing applications using a high throughput electrophotographic reproduction apparatus, a durable toner image, especially a durable multicolor toner image, while at the same time providing a suitable gloss characteristic. However, the durable toner images made using the invention are preferably, but not necessarily, high-gloss images.

In preferred embodiments, the UV-curable toners are preferably substantially transparent in the visible spectrum, and are preferably colorless both before and after crosslinking, i.e., are non-marking particles. Whereas the term "clear toner" in the literature can refer to a colorless toner or alternatively to a transparent toner having a color, in the present specification the terms "clear toner" and "colorless toner" are used interchangeably. Thus "clear toner" and "colorless toner" refer herein to toners that are preferably formulated without added colorant, i.e., which are preferably substantially uncolored. The term "color toner" as employed herein can refer to any conventional marking particles for color imaging, e.g., cyan, magenta, yellow, or black particles.

Figure 1:
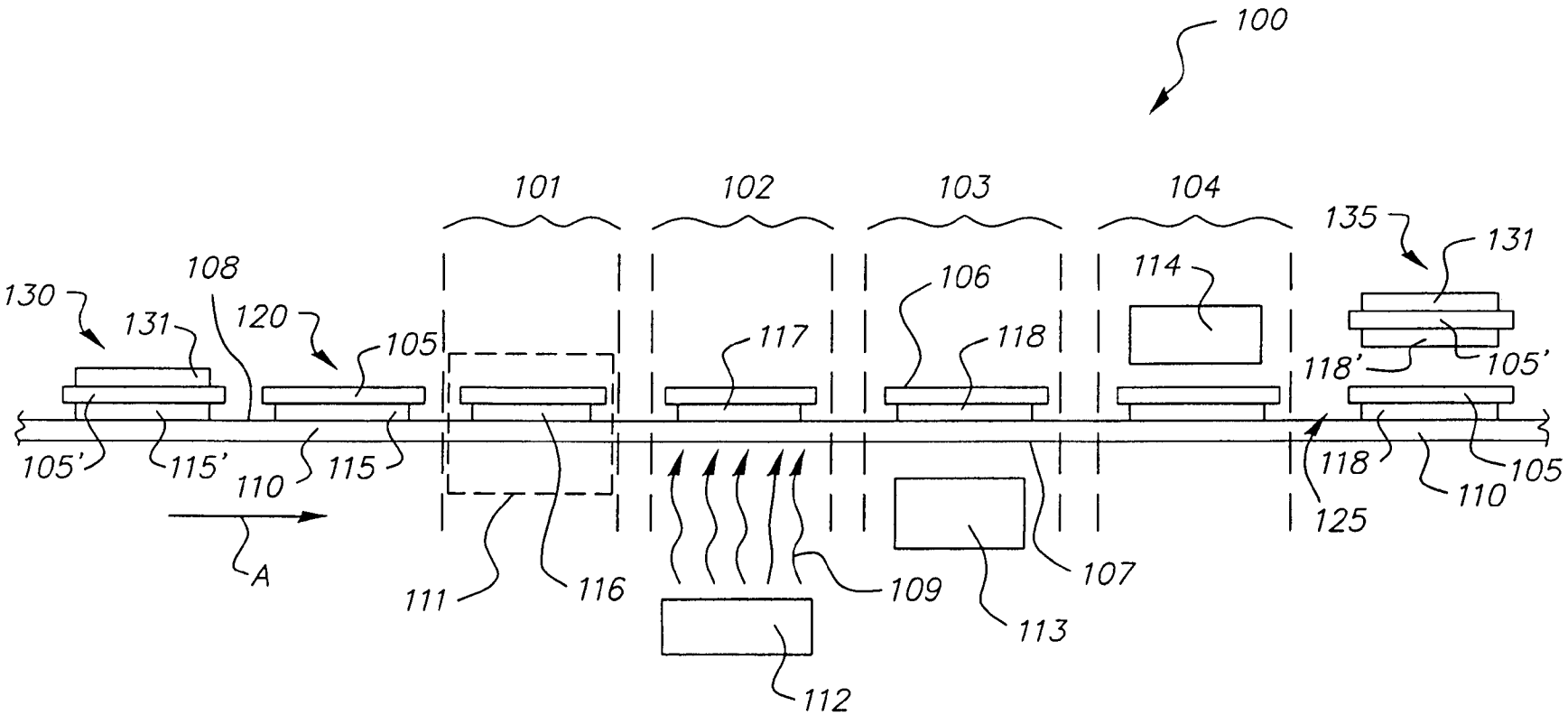
FIG. 1 is a schematic side-view depiction of a generalized glossing apparatus of the invention for making simplex and duplex UV-glossed prints, wherein an input member having thereon a pre-gloss toner image including UV-curable toner is moved, in non-slip association with a smooth UV-transparent web, jointly with the web through four process zones: a heating zone, an exposure zone, a cooling zone, and a separation zone, such that UV curable toner is in contact with the web as the receiver member moves through the process zones.

FIG. 1 is a schematic side-view depiction of a generalized glossing apparatus 100 for making simplex and duplex UV-glossed prints, wherein an input member having thereon a pre-gloss toner image including UV-curable toner is moved, in non-slip association with a smooth UV-transparent web 110, jointly with the web through a plurality of process zones so as to produce an output member in which preferably at least any pictorial area has a glossed, UV-cured, surface.

Glossing apparatus 100, inclusive of a web 110, can be used to make a UV-glossed simplex print or output member 125. An input member 120 for glossing in the glossing apparatus 100 includes a pre-gloss toner image 115 formed on a face of a receiver member 105, e.g., cut sheet, the pre-gloss toner image formed on the receiver member 105 from toner particles via any suitable electrostatographic technique. A receiver member 105 can be made from any suitable material, including papers of various weights and thicknesses, cardboard, and transparency stock (plastic). Pre-gloss toner image 115, which typically includes one or more color toners forming a color pictorial image, has in any area for glossing at least the outermost toner thereof made from UV-curable toner. In any sub-area of such an area for glossing, the outermost toner is the toner located farthest from receiver member 105. The outermost toner can include unfused toner particles, or alternatively, the outermost toner can be toner that has been pre-fused in apparatus other than apparatus 100. The outermost toner, when in an unfused state, includes at least one layer of toner particles, preferably clear or colorless particles. When the outermost toner is in a pre-fused state, the thickness of the pre-fused outermost toner corresponds to at least one layer of the corresponding unfused toner particles prior to pre-fusing.

Glossing apparatus 100 includes four sequential processing zones: a heating zone 101, an exposure zone 102, a cooling zone 103, and a separation zone 104. Apparatus 100 is not restricted to these four processing zones, and a greater or fewer number of processing zones may be used so as to produce, in the spirit of the invention, glossy UV-cured toner images on receiver members.

Web 110 has a UV transparency and a smooth surface 108. Receiver member 105 is jointly movable in association with web 110 successively through the processing zones 101, 102, 103, and 104, as indicated by the arrow, A. The outermost toner included in the pre-gloss toner image 115 contacts surface 108 in non-slip fashion as receiver member 105 passes through these processing zones.

Input member 120 passes first into heating zone 101 which includes a heating mechanism 111 having a controllable source of heat. Any suitable heating mechanism 111 can be used. Preferably, heating mechanism 111 involves a pressure contact between smooth surface 108 and the outermost toner included in pre-gloss toner image 115, which pressure contact exists at least during a time period when receiver member 105 is within heating zone 101. The heating mechanism 111 is for melting at least the outermost toner included in pre-gloss toner image 115, thereby producing a curable toner image 116. UV-curable toner included in at least the outermost toner of image 115 is thus heated to a molten state so as to thereby lose individual particulate identities. (For simplicity of exposition, a "molten state" is defined herein as a state having a temperature $T_g$ at least above the glass transition temperature, preferably well above $T_g$). As indicated by the dotted boundary delineating the heating mechanism 111 in FIG. 1, the heating mechanism preferably heats not only the pre-gloss toner image 115, but also heats receiver member 105 and web 110 during formation of the curable toner image 116.

After leaving the heating zone 101, the receiver member 105 with curable toner image 116 is moved jointly with web 110 into the exposure zone 102 which is inclusive of a radiation source 112 which emits UV radiation for curing UV-curable toner. A key feature of the invention is to have a rapid curing or crosslinking reaction in the UV-curable toner. For this to happen, it is important that the UV-curable toner is in a molten state during curing, i.e., is at a temperature well above the glass transition temperature $T_g$. Therefore, during the time period between leaving the heating zone 111 and passing into the exposure zone 102, the toner melted in the heating zone remains in the molten state, i.e., no significant cooling of the melted toner occurs. Moreover, the molten state should persist inside the curing zone 102 until the UV-induced curing or crosslinking reaction has occurred to a sufficient degree, i.e., so that output member 125 carries thereon an image having a tough, durable, surface. Within the exposure zone 102, UV radiation 109 is emitted by source 112 toward surface 107 (opposite surface 108) such that a flux of UV-radiation is transmitted through web 110 so as to crosslink at least the outermost toner in contact with surface 108, thereby forming a cured toner image 117 on receiver member 105. It should be noted that UV-curable toner, which necessarily contains UV-absorbing moieties, gets heated to some degree by absorption of UV energy transmitted through web 110, thus offsetting the effects of any cooling that tends to occur after receiver member 105 leaves heating zone 101.

The source 112 of UV radiation can be any suitable source, such as for example a halogen lamp, a mercury vapor arc UV lamp, a mercury vapor microwave-powered UV lamp, or a xenon/mercury lamp. Source 112 can include one or more lamps. It should be noted that the total radiation emitted from source 112 can be considerably more than the UV radiation emitted by the source. It is preferred that the UV-radiation component of the total radiation emitted by radiation source 112 provide a UV dose, transmitted through web 110 and reaching crosslinkable UV-curable toner, which is equal to or greater than about 1 Joule/$cm^2$. For efficient crosslinking, it is preferred that the molten state of UV-curable toner be at a temperature of at least about 70° C. during curing. It is known that the curing process raises the glass transition temperature significantly, typically by about 15° C.–20° C., and therefore a curing temperature considerably higher than 70° C. can be important. Generally, a high degree of transparency of web 110 to UV radiation is desirable, so that the UV radiation 109 emitted from source 112 can be efficiently utilized for crosslinking. On the other hand, any radiation absorbed by web 110 in the exposure zone 102, including non-UV radiation, will produce some heating of the web, which can be useful in maintaining the molten condition of melted UV-crosslinkable toner during the curing process. Thus a radiation source 112 which emits both non-UV and UV radiation can be useful in practice of the invention.

On account of preferred heating of web 110 in heating zone 101 and maintenance of elevated temperature of the web in exposure zone 102, the web is preferably made of high performance material so that the web can be used for prolonged periods at elevated temperature without excessive elongation or degradation.

After passage through exposure zone 102, the cured toner image 117 on receiver member 105 moves jointly with web 110 through cooling zone 103. The cooling zone 103 includes a cooling mechanism 113 for cooling the web, which cooling results in the cooling of cured toner image 117 while in intimate contact with surface 108. Preferably, in cooling zone 103, a crosslinked fused toner image 118 is produced having a temperature below a glass transition temperature of any UV-curable toner included therein. However, in certain circumstances, such cooling below $T_g$ can be allowed to come to an end inside separation zone 104 at a time before separation from web 110 occurs. Cooling mechanism 113 can include any suitable device to produce cooling of web 110. Cooling mechanism 113 can include a device for blowing a flow of cooled air against surface 107 of web 110. Alternatively, cooling mechanism 113 can include a cooled surface for contact-cooling of surface 107 of web 110, such as for example a contacting pyroelectric cooling device, or a thermally conductive contacting member cooled by an internal flow of a cold liquid. Moreover, cooling mechanism 113 can include any suitable device such that surface 106 of receiver 105 can be cooled, e.g., either separately, simultaneously, or independently of the cooling of surface 107 of web 110.

Following passage of the receiver member 105 through cooling zone 113, the receiver member is moved jointly with web 110 through separation zone 104, resulting in separation of the receiver member from the web and thereby producing simplex output member 125 (shown fully separated from the web in FIG. 1). Simplex member 125 includes the crosslinked fused toner image 118 formed as a glossy coating on one face of receiver member 105. A separation mechanism 114 can be provided for separating, or aiding separation of, output member 125 from web 110. Separation mechanism 114 can include for example, a blade, a wedge-shaped body, or any suitable separation device. The separation mechanism 114 can also include a device for bending the web 110 so as to free member 125 from contact with the web. In conjunction with, and in consequence of, the cooling action of the cooling mechanism 113, the action of separating mechanism 114 preferably makes any toner offset from output member 125 to web 110 negligible.

Also depicted in FIG. 1 is a duplex input member 130 shown entering glossing apparatus 100 for processing. Member 130 includes a receiver member 105' carrying adhered to one face thereof a pre-gloss toner image 115' in contact with web 110, with a crosslinked fused toner image 118' pre-formed on the opposite face of the receiver member. In the present specification, a prime (') signifies that the characteristics of an element are similar to those of a respective element identified by a numeral which is unprimed. Thus receiver member 105' is similar to receiver member 105, and so forth. Duplex input member 130 is moved jointly with web 110 through the sequential processing zones 101, 102, 103, and 104, thereby forming a duplex UV-glossed print having thereon a crosslinked toner image on each face of receiver member 105, i.e., the crosslinked fused toner image 118' on one face and a crosslinked fused toner image 131 on the opposite face. While duplex UV-glossed prints can be made as described above, it is also possible to make a "mixed" duplex print having only one face glossed. For example, a mixed duplex print can be made in apparatus 100 such that a conventional non-glossed fused toner image is provided on receiver member 105 in lieu of crosslinked fused toner image 118'.

A key feature of the invention is that the smoothness of surface 108 has primary influence in determining the surface smoothness of crosslinked fused toner image 118 on output member 125 and of crosslinked fused toner image 118' on output member 135. Moreover, it is important for achieving high gloss on an output member that melted toner for crosslinking in the exposure zone 102 preferably forms a continuous film having a substantially void-free surface in contact with surface 108. To obtain a substantial yield of highly glossed output prints over time, surface 108 is preferably formed as a smooth exterior of any suitable tough material which is resistant to damage and wear, e.g., from a coating included in web 110. Notwithstanding a preference for a very smooth surface 108, in certain applications a surface 108 can be provided having a predetermined surface roughness for imparting relatively lower gloss. Alternatively, a textured surface can be used, such that the texture will be imparted to the melted toner crosslinked in direct contact with this texture, and thus imparted to images 118 and 118'.

A pre-gloss toner image 115 or 115' preferably includes a color toner image formed on receiver member 105, and the pre-gloss toner image is preferably formed with colorless UV-crosslinkable toner particles deposited in juxtaposition with the color toner image. A color toner image is included in at least a portion of a page-equivalent area on receiver member 105 and contains one or more color toners as a color toner pattern. Certain portions of the page-equivalent area may not be glossed, i.e., contain no UV-curable toner, analogous to partial page glossing disclosed for example in the Ng patent (U.S. Pat. No. 5,234,783). Thus, UV-glossing according to the subject invention need not be full-page in extent, but can be localized to certain predetermined areas. Moreover, a pre-gloss toner image such as image 115 or 115' can include colorless UV-crosslinkable toner particles as a full-page overlay, e.g., in juxtaposition with a full page color toner image, or as a full-page overlay in juxtaposition with a partial-page color toner image.

While it is preferred that the UV-curable toner is clear or colorless toner, the invention includes applications in which color toner can be UV-curable. Thus in an alternative aspect of the invention, a UV-glossing area of a pre-gloss toner image 115 or 115' can include one or more UV-curable color toners, and no clear or colorless toner. In this aspect of the invention, it is preferable that each color toner is separately UV-curable. In view of UV absorption by upper layers and possible screening of underlying layers, it is preferred to employ this alternative when very small toner particles are employed.

In a pre-gloss toner image 115 or 115', a layer (or partial layer) of UV-curable clear toner adjacent surface 108 of web 110 can be formed in a variety of ways. A clear UV-curable toner can be laid down on a photoconductor surface, covered thereon by a color toner image, and the combined clear toner plus color toner image directly transferred to receiver member 105. Alternatively, the clear toner can be laid down on an intermediate transfer member and a color toner image transferred thereon, e.g., from a photoconductor, and the combined clear toner plus color toner image transferred therefrom to receiver member 105. As another alternative, a clear toner can be laid down as a top layer above a color toner image on a photoconductor, whereupon the combined clear toner plus color toner image is transferred therefrom to an intermediate member and then to receiver member 105. Any suitable way of forming a pre-gloss toner image 115 or 115' is contemplated by the invention.

Figure 2:
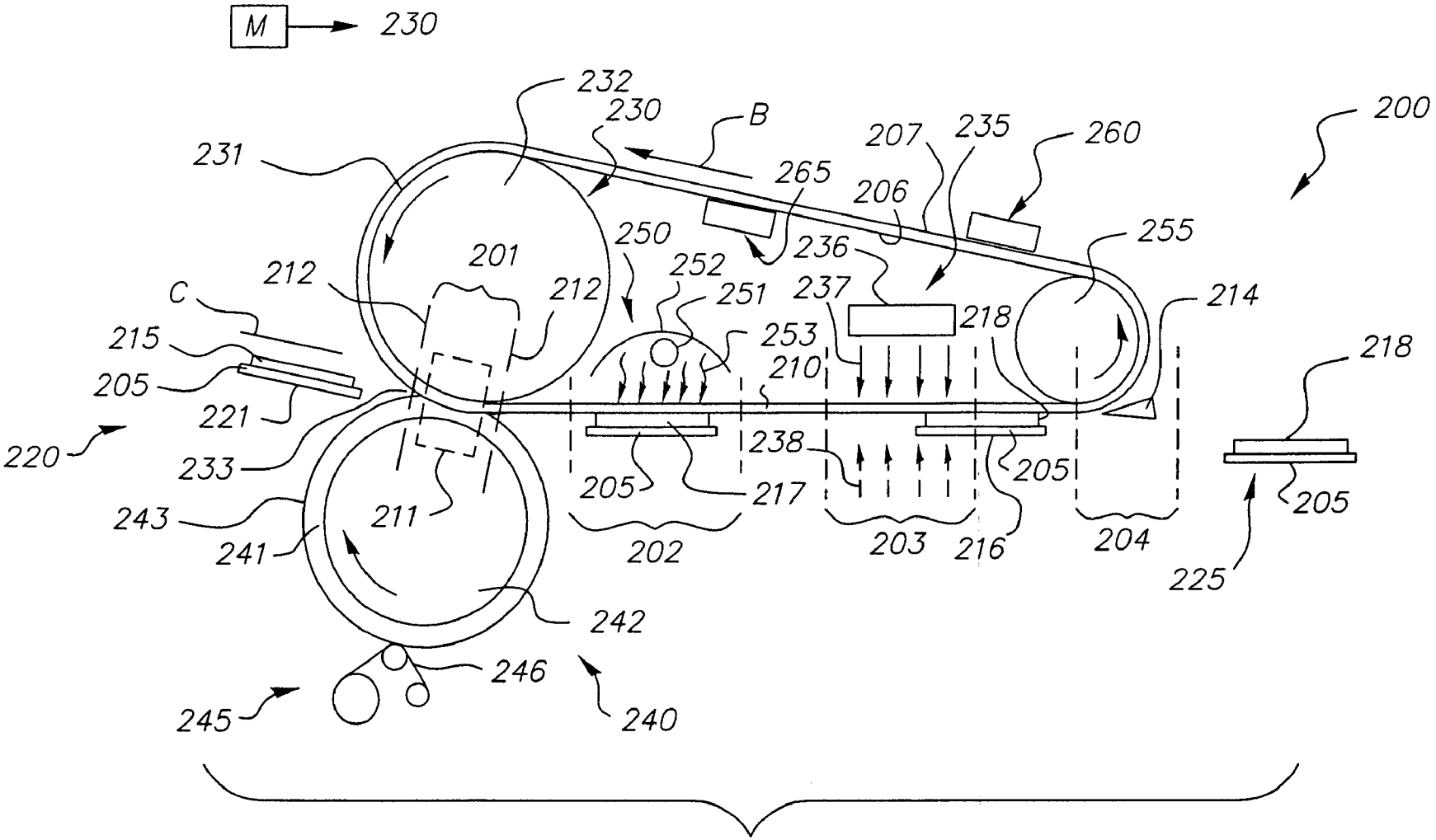
FIG. 2 illustrates, in side view, a preferred embodiment of a glossing apparatus having the form of a belt fuser adapted for UV-glossing and inclusive of: a rotatable closed-loop smooth belt entrained in tension around a heated roller and a steering roller, the belt captured in a nip between the heated roller and a resilient pressure roller, the apparatus including a source of UV radiation located inside the loop for directing UV radiation to the inner surface of the belt, and a cooling mechanism for providing a flow of air to the inner surface of the belt.

FIG. 2 illustrates, in side view, a preferred embodiment 200 of an apparatus of the invention having the form of a belt fuser adapted for UV-glossing of an input member 220, the apparatus inclusive of: a rotatable closed-loop belt 210 entrained in tension around a controllably heated roller 230 and a steering roller 255, the outside of the belt having a preferably smooth surface 207, the belt captured in a nip 233 between the heated roller and a resilient pressure roller 240. Belt 210 has a transparency to UV radiation, and apparatus 200 further includes a source 250 of UV radiation located inside closed-loop belt 210, which source directs UV radiation toward the inner surface 206 of the belt such that UV radiation transmitted through the belt produces crosslinked toner images. Also included in apparatus 200 is a cooling mechanism 235 for cooling belt 210. Roller 230, which is rotated counterclockwise by a motor M, drives belt 210 in the direction of the arrow B. Movement of belt 210, which is in driving contact with rollers 240 and 255, causes rollers 240 and 255 to rotate as indicated. While it is preferred to drive roller 230 by motor M, the motor can alternatively drive roller 240. Moreover, belt 210 may be entrained around more than two rollers (not illustrated). For example, a relatively longer belt 210 could encompass one or more idler rollers. An operational speed of belt 210 is preferably at least 6 ips (15 cm/sec).

Apparatus 200 can be used for making simplex UV-glossed prints, duplex UV-glossed prints, and "mixed" duplex prints, such as described in relation to apparatus 100 of FIG. 1. As illustrated in FIG. 2, a simplex input member 220 for glossing, inclusive of a receiver member 205, carries a pre-gloss toner image 215. Member 220 is moved toward nip 233 in direction of arrow C, for subsequent passage through four processing zones, i.e., heating zone 201, exposure zone 202, cooling zone 203, and separation zone 204. Exposure zone 202 and cooling zone 203 are sequentially located between nip 233 and steering roller 255.

Heated roller 230 includes a cylindrical element 232 made from metal, preferably aluminum having polished surface 231. Roller 230 is preferably internally heated in controllable fashion, e.g., using an internal variable-power lamp (not shown). Alternatively, roller 230 can be heated by an external heating mechanism, e.g., via contact with an externally located heated roller (external heating mechanism not illustrated). A preferred temperature range the roller 230 is approximately between 130° C.–170° C., and more preferably, between 140° C.–160° C.

Pressure roller 240 is a resilient (or compliant) roller which includes a cylindrical element 242 preferably made of aluminum around which is coated a deformable layer 241 preferably made of RTV thermoplastic. It is preferred that layer 241 be made of Silastic J preferably having thickness in a range of approximately between 3 mm–10 mm, and more preferably, having thickness of about 5 mm (Silastic J is a tradename for RTV silicone rubber available from Dow Corning Corporation, Midland Mich.). Roller 240 is preferably unheated. However, an active heating source for heating of roller 240 can be included in apparatus 200 (active heating source not shown). Outer surface 243 can have coated thereon a thin release layer (not shown) or have a treatment to give a low-energy surface so as to prevent UV-curable toner, particularly unfused UV-curable toner, from offsetting on to pressure roller 240.

Nip 233 is a pressure nip wherein layer 241 is deformed, e.g., via an engagement between rollers 230 and 240, which determines the pressure in the nip and hence the nip width. The engagement can be adjusted, at least in principle, for different thicknesses of input members. A force is applied between rollers 230 and 240 which is preferably in a range of approximately between 50 pounds per linear inch and 150 pounds per linear inch, and more preferably, the force is about 100 pounds per linear inch. A resulting nip width is preferably in a range of approximately between 10 mm–25 mm, and more preferably the nip width is about 18 mm. Nip 233 can accommodate an input member 220 with a range of weights. A receiver member 205 can for example have a weight typically in a range of approximately between 118 $g/m^2$–300 $g/m^2$.

Pressure roller 240 is preferably provided with a cleaning mechanism 245 for cleaning surface 243, e.g., for removal of paper dust and/or toner. A preferred cleaning mechanism includes a cleaning web 246 which rubs against surface 243. Cleaning web 246 preferably comes in a roll, with the web being advanced periodically using a take-up roller so as to provide a fresh cleaning surface.

Steering roller 255 preferably has a diameter smaller than the diameter of heated roller 230. A typical diameter of roller 255 is between 2.5 cm–4 cm. A relatively small diameter for roller 255 is important for at least initiating the release of output member 225 from belt 210 in the separation zone 204. The steering roller 255 is castered and/or gimbaled to assure proper tracking of belt 210 as it moves about the closed loop path.

In embodiment 200, the heating mechanism in heating zone 201 includes the hot contact area of the nip 233 (shown enclosed in FIG. 2 by the dotted line 211). The heating zone 201 can extend beyond the contact area of the nip, as indicated by the dashed lines 212, e.g., because of heat radiated outside of the nip by roller 230. Furthermore, a post-nip wrap of belt 210 around roller 230 can be provided so as to extend the heating zone beyond the actual contact area of the nip (post-nip wrap not illustrated).

Roller 230 is required to be sufficiently hot so as to melt at least UV-curable toner in contact with surface 207 of belt 210. Moreover, fusing temperature in nip 233 must be high enough so that the molten state of UV-curable toner persists while receiver member 205 is moved toward and into the exposure zone 202. However, with a UV-curable colorless or clear toner outermost in pre-gloss toner image 215, it is preferred that melted outermost toner particles do not flow into or mix with underlying color layers, e.g., if the underlying layers of the pre-gloss toner image are not pre-fused.

A molten state of at least the UV-curable toner in contact with surface 207 is maintained inside the exposure zone 202 until a suitable or predetermined amount of crosslinking has occurred via transmission of UV radiation through belt 210, thereby forming a cured toner image 217. Source 250 of UV radiation 253 can be any suitable source, such as for example a tubular UV-lamp 251 extending across belt 210 and preferably provided with a suitably shaped reflector 252. The transparency to UV radiation of belt 210 preferably allows a transmitted flux of UV radiation through the belt having a power density of at least approximately 1 Joule/$cm^2$.

In the illustrated configuration of embodiment 200 in FIG. 2, a film of melted toner is formed in the nip 233 between belt 210 and receiver member 205. Adhesion between this film of melted toner and surface 207 allows receiver member 205 to be transported on the underside of the closed loop of belt 210 from heating zone 201 through the exposure zone 202. Furthermore, adhesion between this melted film of toner and the underlying toner and/or the receiver member 205 is equally important.

After UV exposure, receiver member 205 with cured toner image 217 is transported through the cooling zone 203, where the cured toner image is cooled to a temperature close to the glass transition temperature of the crosslinked UV-curable toner contacting surface 207, thereby forming a crosslinked fused toner image 218. The adhesive forces continue to act as the receiver member 205 is moved jointly with the belt 210 through cooling zone 203 until separation in zone 204. Preferably, cooling in the cooling zone by cooling mechanism 235 causes the temperature of any toner included in image 218 to fall close to the respective $T_g$, or below. However, beneficial cooling (not provided by cooling mechanism 235) can also occur outside of the cooling zone 203, i.e., between cooling zone 203 and the separation zone 204, and also within the separation zone. As a result, the cooling within cooling zone 203 can be augmented somewhat so that during eventual actual separation of output member 225 in separation zone 204, any toner in image 218 preferably has a temperature below its $T_g$.

Cooling mechanism 235 preferably includes a device 236 for blowing a flow of cooling air 237 against inner surface 206 of belt 210, thereby cooling the belt as well as cooling image 217 and receiver member 205. Device 236 can include one or more fans. Alternatively, device 236 can include a set of nozzles through which air can be blown from a source of air, e.g., a source of air piped from an external supply. An additional flow of cooling air 238 can optionally be blown against the outside surface 216 of receiver member 205 by an auxiliary device included in cooling mechanism 235 (auxiliary device not illustrated). It has been found that with a belt speed of 6 ips, a flow rate for cooling air 237 (not pre-cooled) is preferably in a range of approximately between 40 cubic feet per minute–50 cubic feet per minute. However, any suitable flow rate can be used.

Receiver member 205 (with crosslinked fused toner image 218) is shown leaving cooling zone 203 for release from surface 207 in separation zone 204. A separation mechanism for use in zone 204 can include any suitable device to assist this release, preferably a blade or wedge-shaped body 214. In conjunction with the preferred relatively small radius of curvature of steering roller 255, blade 214 can guide the leading edge of receiver member 205 away from roller 255 during separation of simplex output member 225. Preferably a gloss imparted to the durable glossed toner image on member 225 has a $G_{20}$ value equal to or greater than or equal to approximately 70.

As illustrated in FIG. 2, apparatus 200 is shown oriented such that input member 220 arrives at nip 233 with the pre-gloss toner image 215 on the upper surface of receiver member 205, with roller 230 above roller 240. In this orientation, the pre-gloss toner image 215 can be in an unfused state, i.e., such that gravity can act so as to help keep unfused toner particles in place. However, as described above, the orientation shown in FIG. 2 requires that adhesive forces hold the receiver member 205 to surface 207 during the UV-exposing and cooling operations.

In an alternative orientation (not explicitly shown in FIG. 2) both the apparatus 200 and the input member 220 are upside down (i.e., with roller 240 above roller 230, and pre-gloss toner image 215 underneath receiver member 205). In the alternative orientation, image 215 can be cured and cooled without need of such adhesion. This simplification can be useful when at least any conventional (non-curable via UV) toner particles of the pre-gloss toner image 215 are held securely enough so that member 220 can be manipulated into position for upside-down entry into nip 233, i.e., without undue disturbance of the conventional toner particle locations. Therefore, the conventional toner particles are preferably thermally or otherwise "tacked" to receiver member 205 prior to arrival at nip 233, and more preferably, pre-fused thereon in a fusing station external to apparatus 200.

In lieu of simplex input member 220, an input duplex member for glossing in apparatus 200 can additionally carry on face 221 of receiver member 205 a pre-formed UV-glossed toner image (e.g., priorly glossed in apparatus 200) for producing a duplex UV-glossed print, or alternatively, the input duplex member can additionally carry on face 221 a pre-formed non-glossed toner image, i.e., for producing a duplex "mixed" print in apparatus 200 (input duplex members not illustrated).

A cleaning station 265 is preferably provided so as to prevent buildup of dirt or other contamination on the inside surface 206 of the belt 210, which buildup could compromise efficient UV transmission through the belt. Any suitable cleaning mechanism can be employed in station 265. It is preferred that a cleaning mechanism include a pad that can rub against surface 206, i.e., continuously or intermittently (not illustrated). Intermittent rubbing is preferred. A cleaning of surface 206 using a pad can be initiated on a regular predetermined schedule, or alternately can be initiated as required, e.g., as determined by visual examination or by measurement of radiation (e.g., UV or visible light) transmitted through belt 210. A cleaning pad made of Nomex® fabric on a compliant support is preferred. Nomex® fabric is available from DuPont, Wilmington, Del.

Of key importance for apparatus 200 is that the smoothness of outside surface 207 is the primary determinant of gloss imparted to the durable glossed toner image carried by simplex output member 225. Thus surface 207 is required to be free of any substance which can affect this smoothness, such as for example, particulate contamination including toner particles, dust, and fibers on surface 207. It is important to prevent such material from becoming bonded to surface 207, e.g., after long usage of the belt. It may suffice that contamination on surface 207 can transfer to surface 243 of roller 240 and thus be removed therefrom by cleaning mechanism 245. Alternatively, a cleaning station 260 may be provided for cleaning the smooth surface 207 on the outside of belt 210. Any suitable cleaning mechanism can be employed in cleaning station 260.

In a preferred embodiment, the apparatus 200 advantageously does not require the outside surface 207 of belt 210 to be treated with a release compound, such as for example a polydiorganosiloxane release oil, or zinc stearate, or other low surface energy compound. In apparatus 200, separation in zone 204 preferably occurs without the use of replenishable release material on belt 210. Use of such a material would require an additional station for application of the material to the surface 207, e.g., an oiling station.

Apparatus 200 can be housed inside an electrophotographic machine for "in-line" or "parallel-line" usage therein, as described above. Or, apparatus 200 can be located within adjunct equipment attached to an electrophotographic reproduction apparatus. Alternatively, apparatus 200 can be housed in a stand-alone or "off-line" accessory unit (see for example FIG. 4). Furthermore, apparatus 200 as an accessory unit can be employed "near-line", i.e., set points for processing zones can be electronically controlled or adjusted by means of information sent to apparatus 210, e.g., from an associated electrophotographic reproduction apparatus. Such information can for example be used for adjusting the temperature and/or engagement in nip 233, the UV exposure from device 252, and the flow rate and/or temperature of the flow of air 237 (or of air 238). Such adjustments of set points can be carried out for example when different types of receiver members having varying weights and/or thicknesses are sent to apparatus 200 for UV-glossing, or when different types and/or coverages of color toners are used in pre-gloss toner images.

Figure 3:
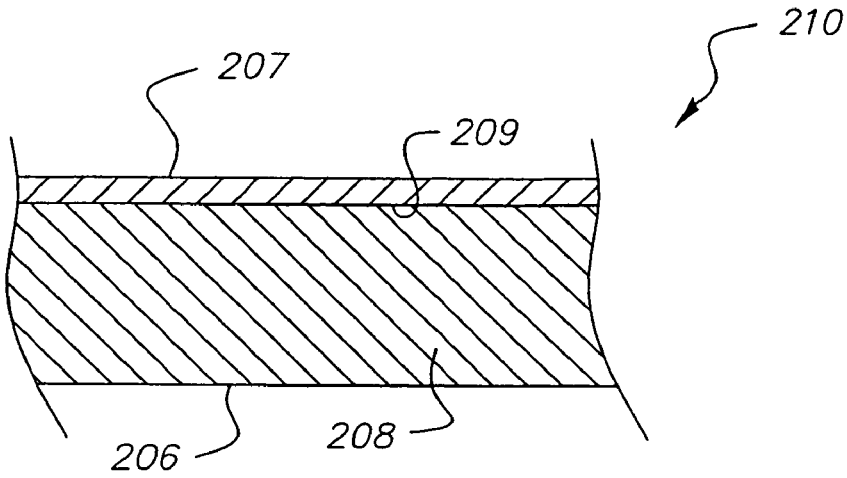
FIG. 3 illustrates, in cross-section, a portion of a preferred embodiment of a belt for use in the apparatus of FIG. 2.

A portion of a preferred embodiment of belt 210 of FIG. 2 is illustrated in cross-section in FIG. 3. A flexible material, having high-temperature stability and high-temperature strength, is preferably used for the main layer 208 of belt 210. A relatively thin, tough, flexible, long-wearing overcoat 209 having a preferably smooth outer surface 207 is preferably formed on the outward facing surface of the main layer 208. The overcoat 209 is preferably hard so that surface 207, even after long use in apparatus 200, remains substantially free of mechanical damage such as scratches, i.e., remains smooth overall for substantially blemish-free glossing. Surface 207 of coating 209 preferably has a $G_{60}$ gloss number equal to or greater than about 80 (when new). The $G_{60}$ gloss number depends on a preferably controllable manufactured surface finish of surface 207. It is preferred that main layer 208 has a thickness less than or equal to about 50 micrometers. It is preferred that overcoat 209 has a thickness of approximately about 5 micrometers.

A transparency to UV radiation is a requirement for both the main layer 208 and the outer coating 209. Preferably, each of the layer 208 and the overcoat 209 has a high degree of transparency, such that the combined layers together preferably exhibit at least 70% transmission of the incident crosslinking UV radiation included in flux 253 (FIG. 2). For example, 75% transmission in layer 208 could be coupled with 95% transmission in layer 209, giving a combined transmission of about 71%.

A preferred material for the main layer 208 is a polyimide. Certain useful polyimide materials are commercially available from Specialty Materials, a division of Brewer Science Limited, Derby, United Kingdom. In order for these polyimide materials to be useful, a suitable crosslinking reaction chemistry in the (molten) UV-curable toner should have high efficiency. In order to avoid excessive temperature rises and/or radiation induced aging of belt 210, the amount of incident UV radiation absorbed by these same materials is preferably at least smaller than the amount of transmitted UV radiation. Thus for a preferred polyimide material having UV-transmission of at least 80% for a 0.001" (25.4 micrometer) thick layer, a corresponding layer having a thickness of 50 micrometers would have a UV-transmission of about 64%.

A preferred material for the overcoat 209 is a sol-gel. Such a material is described, for example, in the Clark patent (U.S. Pat. No. 3,986,997). Readily coatable sol-gel materials are known for use as protective coatings for electrophotographic rollers. A preferred sol-gel material having the tradename Ultrashield is available from Optical Technologies, Long Island City, N.Y. A sol-gel coating generally absorbs only a small fraction of incident UV radiation. A layer 209 of preferred thickness 5 micrometers typically has a transmission of say 95%, which in conjunction with an 80% transmission for the main layer 208 will give an overall transmission of 76%, and in conjunction with 64% transmission for the main layer will give an overall transmission of about 61%.

Colorless UV-curable toners useful for forming overlayers in pre-gloss toner images include a suitable sensitizer (or UV-absorber) to absorb UV radiation in the exposure zone 202. Any suitable particle size may be used. In particular, the particle size of a clear or colorless toner can be larger than the size(s) of color toner particles used to make a pre-gloss toner image. UV-curable toner particles useful for forming pre-gloss toner images preferably are surface treated in well known manner, i.e., so as to have adsorbed submicron surface particles on their surfaces, e.g., submicron particles of silica, alumina, and the like.

Figure 4:
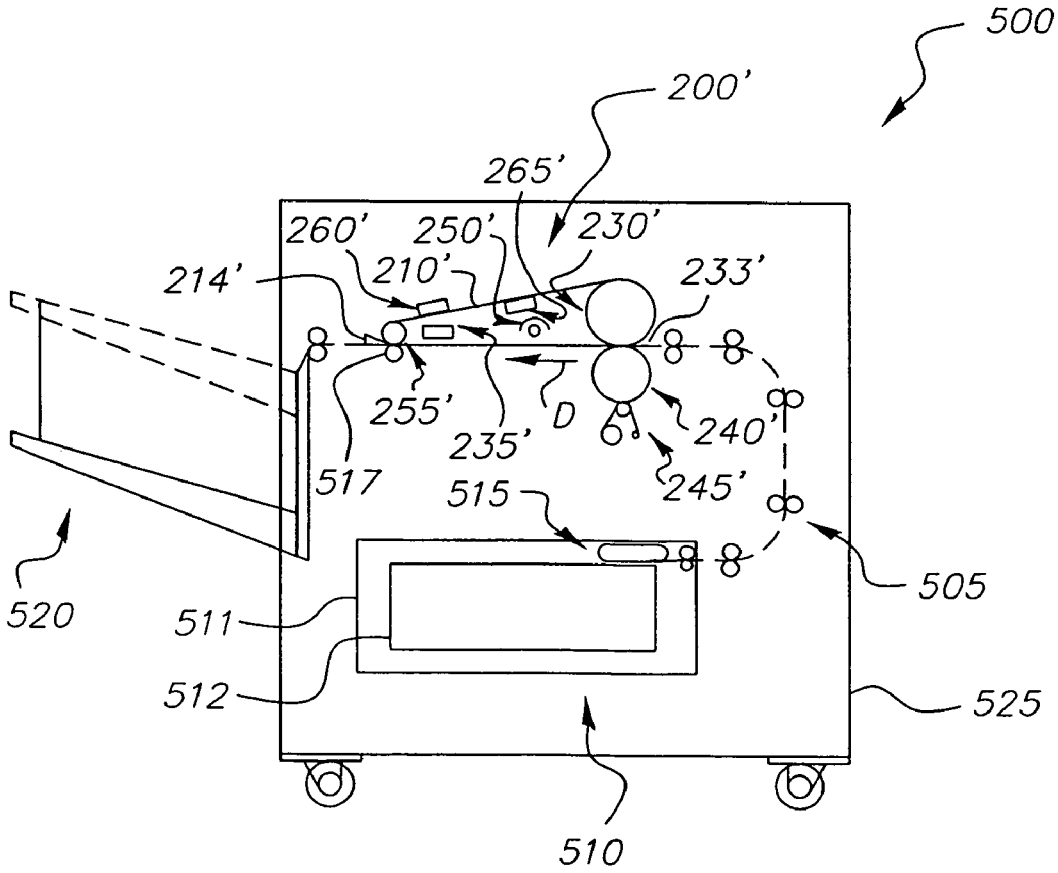
FIG. 4 shows in side view a stand-alone UV-glossing accessory of the invention.

FIG. 4 shows, in side view, an embodiment 500 of a stand-alone UV-glossing accessory according to this invention. Embodiment 500 can be operated as an "off-line" unit, and more preferably, as a "near-line" unit as described above. Included in embodiment 500 is a UV-glossing apparatus 200', similar to that illustrated in FIG. 2, and housed in cabinet 525. In FIG. 4, elements identified by numerals having a prime (') are entirely similar to corresponding elements of apparatus 200. Thus a receiver member (not shown in FIG. 4) can be moved into nip 233' formed by rollers 230' and 240', which rollers capture a UV-transparent belt 210' entrained around heated roller 230' and steering roller 255'. A sheet supply 510 includes a housing 511 and sheets for glossing included in stack 512. A receiver member carrying a pre-gloss toner image can be moved from the stack 512 by a device 515 and fed into a plurality of transport rollers, e.g., rollers 505. Stack 512 preferably has a capacity of at least 1000 sheets. In the accessory unit 500, vertical and horizontal transport rollers are included so as to move the receiver member for glossing from device 515 into nip 233'. The input member is then moved through UV-glossing apparatus 200' in direction of arrow D, and the resulting output member delivered to an output tray 520. During separation of an output member from belt 210', a free-wheeling roller 517 is used to help support the output member. The cooling mechanism 235' preferably provides an upper cooler for providing flow of air analogous to flow of air 237 of FIG. 2, and a lower cooler for providing an auxiliary flow of air analogous to auxiliary flow of air 238 (upper cooler, lower cooler, and airflows not shown). Accessory unit 500 can be used to make simplex UV-glossed prints, duplex UV-glossed prints, and "mixed" prints for which only one face is glossed.

To make a duplex glossed print in embodiment 500, a stack simplex prints can taken from tray 520 and put through a conventional electrophotographic reproduction apparatus (not shown) so as to form on each of the opposite faces a new pre-gloss toner image, and the stack returned to accessory unit 500 for these pre-gloss toner images to be glossed in manner as described above for the simplex prints. Preferably, for making duplex UV-glossed prints, each of the sheets initially placed in stack 512 has on each face a preferably pre-fused pre-gloss image, so that after one set of faces has been UV-glossed, the output members from the first glossing are removed from tray 520 and placed into housing 511 so that in a second glossing the opposing faces can be UV-glossed. To make "mixed" prints, simplex UV-glossed output members are delivered from tray 520 to a conventional electrophotographic reproduction apparatus (not shown) so that non-glossed toner images can be formed on the opposing faces.

FIG. 5 schematically illustrates certain input members carrying pre-gloss toner images for use to make UV-glossed simplex prints with apparatus of the invention.

Figure 5A:
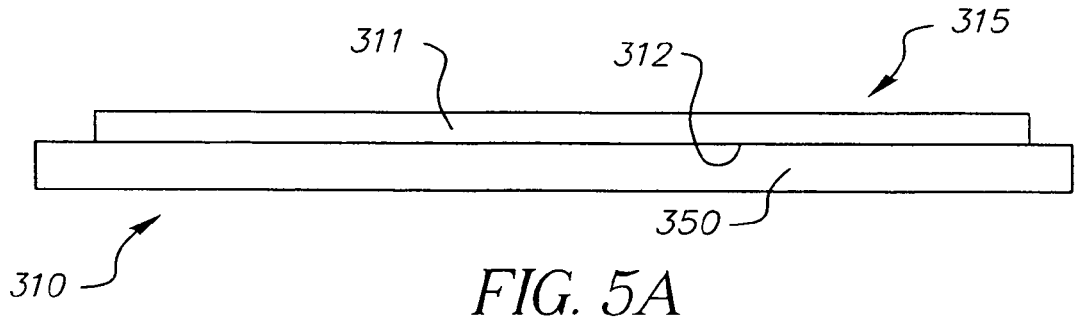
FIG. 5 schematically illustrates certain input members carrying pre-gloss toner images for use to make UV-glossed simplex prints with apparatus of the invention.

In FIG. 5*a*, input member 310 includes a receiver member 350 having thereon a full-page pre-gloss toner image 315 which includes layer 311 formed on face 312 of the receiver member. Layer 311, which can be made of unfused toner or of pre-fused toner, includes one or more UV-curable color toners but no UV-curable colorless toner.

Figure 5B:
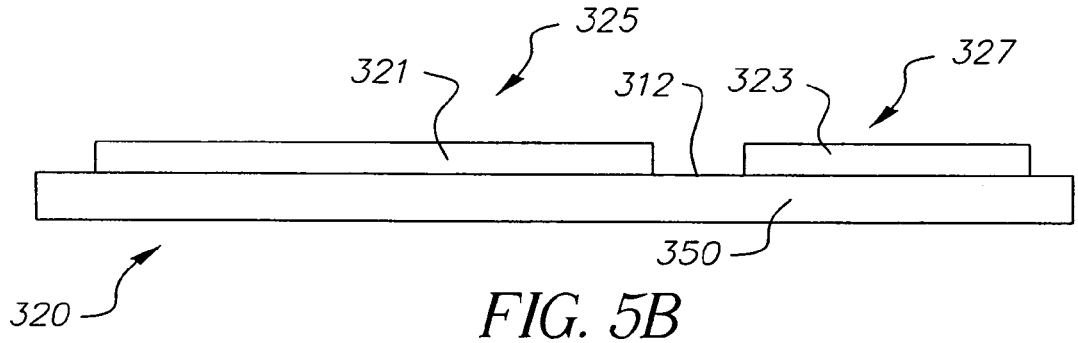

In FIG. 5*b*, input member 320 includes a receiver member 350 having thereon a partial-page pre-gloss toner image 325 which includes layer 321 formed on face 312 of the receiver member. Layer 321, which can be made of unfused toner or of pre-fused toner, includes one or more UV-curable color toners but no UV-curable colorless toner. A pre-fused layer 321 has been fused conventionally in an electrophotographic reproduction apparatus. Also included on input member 320 is a partial-page non-pictorial toner image 327 including layer 323 formed on face 312. Layer 323 is typically a text layer, i.e., an incompletely-covering layer, which can include black toner and/or color toner (for accent color, for line art, and so forth). Toner included in layer 323 can be made of unfused toner or of pre-fused toner, but is not UV-curable in a glossing apparatus of the invention. Thus image 327 can be a matte image.

Figure 5C:
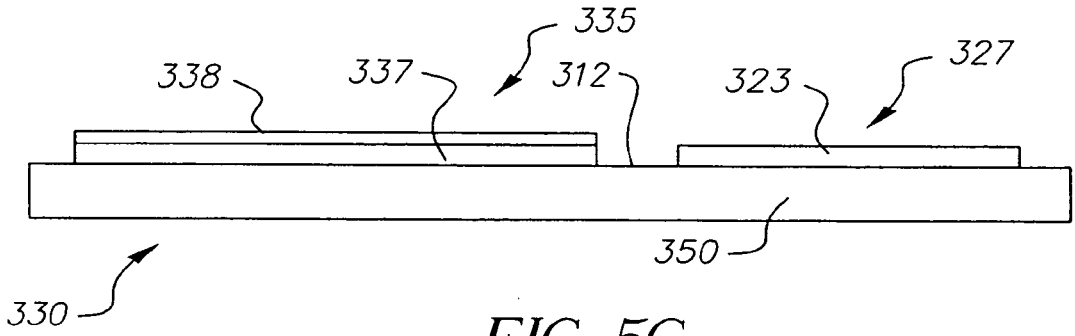

In FIG. 5*c*, input member 330 includes a receiver member 350 having thereon a partial-page pre-gloss toner image 335 which includes layer 337 formed on face 312 of the receiver member and layer 338 formed in juxtaposition with layer 337. Layer 337, which can be made of unfused toner or of pre-fused toner, includes one or more color toners but no UV-curable toner. Layer 338 is made of preferably colorless or clear UV-curable toner which can be unfused or pre-fused. Also included on input member 320 is a partial-page non-pictorial toner image 327 entirely similar to that included in input member 320.

Figure 5D:
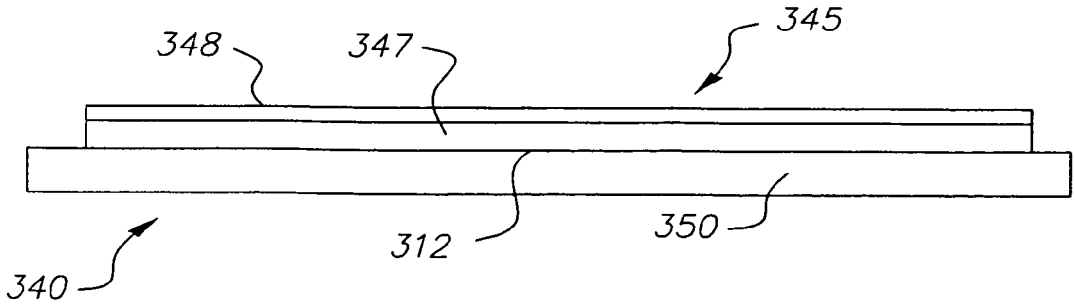

In FIG. 5*d*, input member 340 includes a receiver member 350 having thereon a full-page pre-gloss toner image 345 which includes layer 347 formed on face 312 of the receiver member and layer 348 formed in juxtaposition with layer 347. The characteristics of layers 347, 348 are respectively entirely similar to the characteristics of layers 337, 338.

FIG. 6 schematically illustrates certain input members carrying pre-gloss toner images for use to make UV-glossed duplex prints with apparatus of the invention.

Figure 6A:
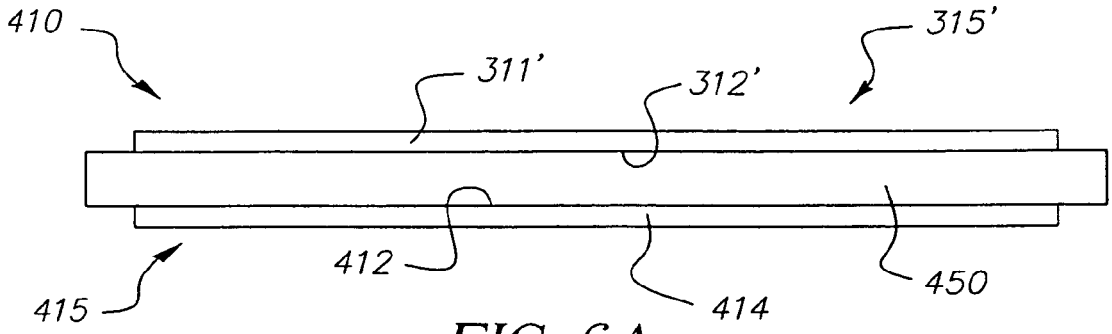
FIG. 6 schematically illustrates certain input members carrying pre-gloss toner images for use to make UV-glossed duplex prints with apparatus of the invention.

In FIG. 6*a*, input member 410 includes a receiver member 450 having thereon a full-page pre-gloss toner image 315' which is entirely similar to image 315 of FIG. 5*a* and includes layer 311' formed on face 312' of the receiver member. On the opposite face 412 of receiver member 450 is a full-page UV-glossed image 415 previously made in a glossing apparatus of the invention from a pre-gloss toner image entirely similar to pre-gloss image 315 of FIG. 5*a*. Thus UV-glossed layer 414 of image 415 includes one or more UV-cured color toners (but no UV-cured colorless toner).

Figure 6B:
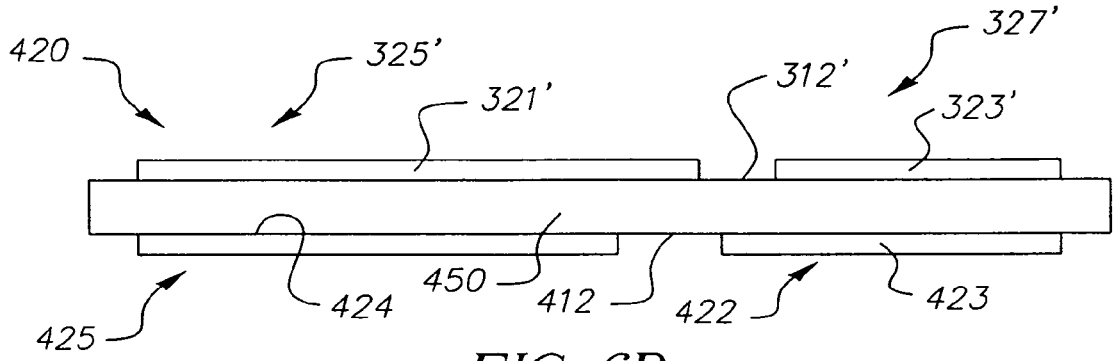

In FIG. 6*b*, input member 420 includes a receiver member 450 having thereon a partial-page pre-gloss toner image 325' which is entirely similar to image 325 of FIG. 5*b*. Also included in input member 420 is a partial-page non-pictorial toner image 327' which is entirely similar to image 327. On the opposite face 412 of receiver member 450 is shown a partial-page UV-glossed image 425 previously made in a glossing apparatus of the invention from a pre-gloss toner image entirely similar to pre-gloss image 325 of FIG. 5*b*. Thus UV-glossed layer 424 of image 425 includes one or more UV-cured color toners (but no UV-cured colorless toner). Also shown on the opposite face 412 is a partial-page non-pictorial toner image 422 which is preferably made from toner that is not UV-curable. Layer 423 of image 422 results from passing a layer similar to layer 323' through a glossing apparatus of the invention, preferably in conjunction with the curing therein of UV-glossed image 425. In a variation, image 425 can be a full-page UV-glossed toner image (image 422 absent). In another variation, image 422 can be a full-page toner image containing no UV-cured toner (image 425 absent).

Figure 6C:
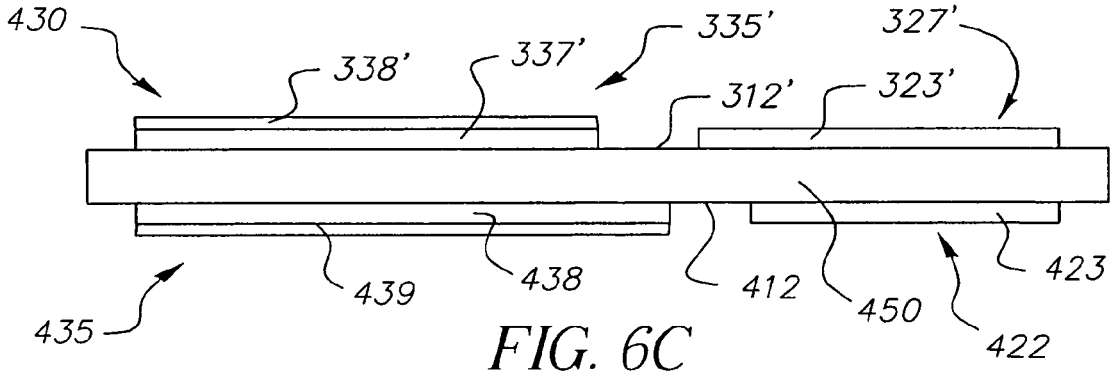

In FIG. 6*c*, input member 430 includes a receiver member 450 having thereon a partial-page pre-gloss toner image 335' which is entirely similar to image 335 of FIG. 5*c*. Also included is a non-pictorial toner image 327' similar to that included in the input member 420. On the opposite face 412 of receiver member 450 is shown a partial-page UV-glossed image 435 previously made in a glossing apparatus of the invention from a pre-gloss toner image entirely similar to pre-gloss image 335 of FIG. 5*c*. Image 435 thus includes a layer 438 corresponding compositionally to layer 337' and a UV-cured preferably clear toner overlayer 439. Also shown on face 412 is a partial-page non-pictorial toner image 422 similar to that included in input member 420. In a variation, image 435 can be a full-page UV-glossed toner image (image 422 absent). In another variation, image 422 can be a full-page toner image containing no UV-cured toner (image 435 absent).

Figure 6D:
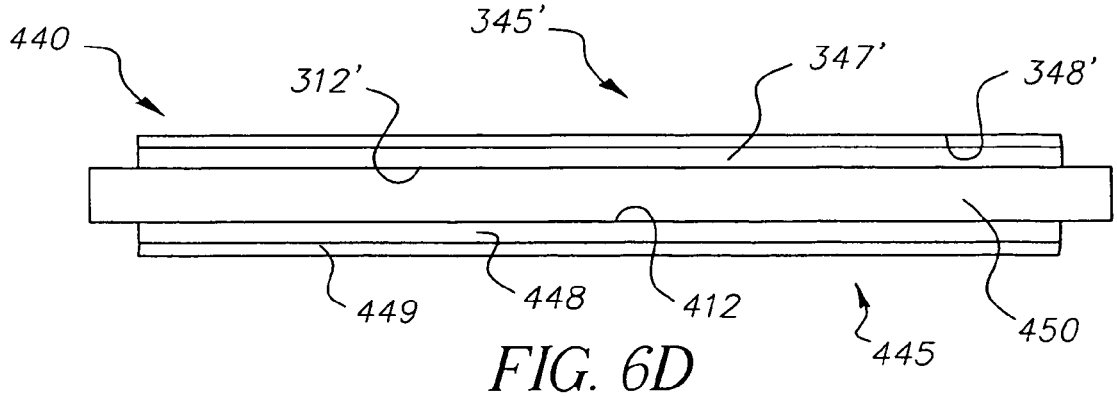

In FIG. 6*d*, input member 440 includes a receiver member 450 having thereon a full-page pre-gloss toner image 345' which is entirely similar to image 345 of FIG. 5*d*. On the opposite face 412 of receiver member 450 is a full-page UV-glossed image 445 previously made in a glossing apparatus of the invention from a pre-gloss toner image entirely similar to pre-gloss image 345'. Image 445 thus includes a layer 448 corresponding compositionally to layer 347' and a UV-cured preferably clear toner overlayer 449.

Figure 7A:
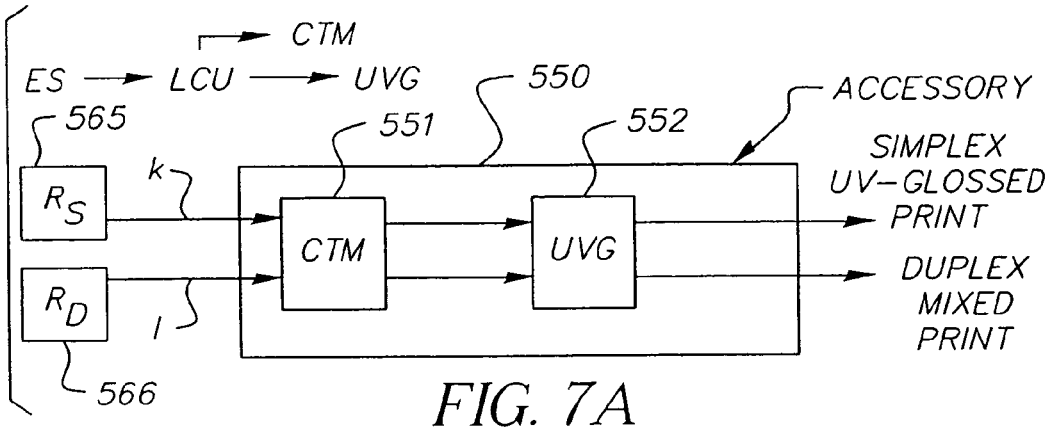
FIGS. 7*a, b* show block diagram sketches featuring an accessory unit embodiment which includes UV-glossing apparatus of the invention.

FIGS. 7*a, b* show block diagram sketches featuring an accessory unit embodiment 550 which includes UV-glossing apparatus of the invention for making simplex and duplex prints. Accessory 550 is preferably used as a stand-alone "near-line" unit, but is not restricted to such usage. Within unit 550 are included a UV-glossing (UVG) apparatus 552 of the invention and a colorless toner module (CTM) 551.

FIG. 7*a* illustrates how embodiment 550 can be used to UV-gloss one side of an input member ($R_S$) 565, which is a receiver member carrying a simplex color toner image. This color toner image is preferably made from conventional (non-UV-curable) color toner, which color toner is preferably fused. Input member $R_S$ is moved along path k, into the accessory 550 and is first processed by being passed through the colorless toner module 551. In CTM 551, a layer of preferably colorless UV-curable toner particles is deposited in juxtaposition with the simplex color toner image, following which the member is moved through UV-glossing apparatus 552 to emerge from unit 550 as a simplex UV-glossed print. UVG 552 is preferably similar to apparatus 200 of FIG. 2. Similarly, an input member $R_D$ (566) can be used. $R_D$ carries on each face a duplex color toner image made from conventional (non-UV-curable) color toner that is preferably in a fused state (on both faces of $R_D$). Member 566 is moved into unit 550 along the path 1, and thence through CTM 551 and UVG 552, thereby resulting in a duplex "mixed" print as the output member. In a variation of the method used with embodiment 550, a fusing or tacking operation can be carried out between the module 551 and the UV-glossing apparatus 552. For "near-line" operation, electronic signals (ES) are sent, e.g., from an associated electrophotographic reproduction apparatus wherein $R_S$ and $R_D$ are made, to a logic and control unit (LCU) and from thence to the CTM 551 and the UVG 552. These electronic signals are used to control operational setpoints in the CTM and UVG, e.g., to make adjustments to the setpoints for different types of receiver members, and so forth.

Figure 7B:
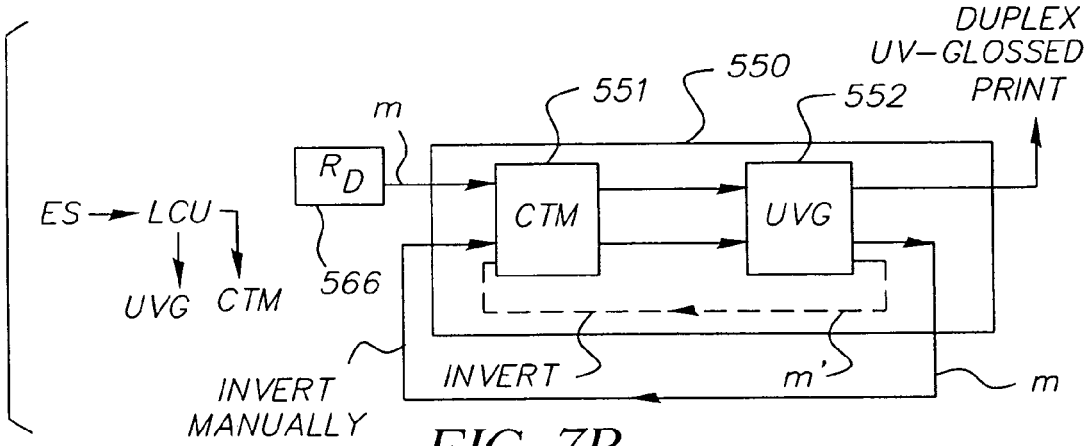
FIGS. 7*c, d* show block diagram sketches featuring an alternative accessory unit embodiment which includes UV-glossing apparatus of the invention.

FIG. 7*b* illustrates how embodiment 550 can be used to make duplex UV-glossed prints. An input member $R_D$ is moved along path m, through CTM 551 and UVG 552 and out of the accessory having one face UV-glossed. The member is inverted (turned upside down) manually and then repassed through the accessory 550 to emerge as a duplex UV-glossed print. Alternatively, the member having one face UV-glossed is moved along a path m' within the unit 550 to a mechanism (not shown) for inverting the member, which inverted member is then moved through CTM 551 and UVG 552 and then out of the accessory as a duplex UV-glossed print.

Figure 7C:
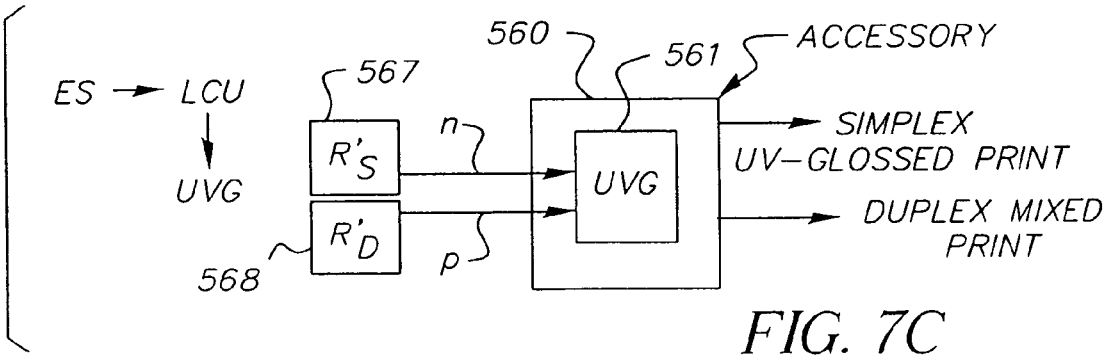

FIGS. 7*c, d* show block diagrams featuring an alternative accessory unit embodiment 560 which includes UV-glossing apparatus of the invention for making simplex and duplex prints. Accessory 560 is preferably used as a stand-alone "near-line" unit, but is not restricted to such usage. Within unit 560 is included a UV-glossing (UVG) apparatus 561 of the invention.

Figure 7D:
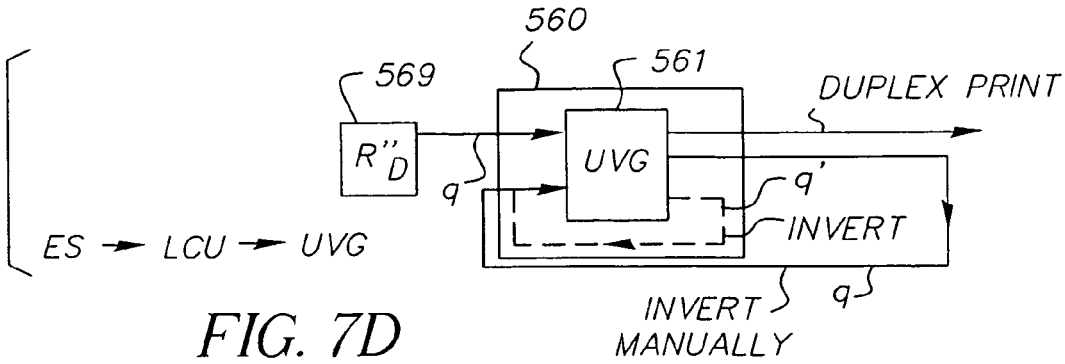

FIG. 7*c* illustrates how embodiment 560 can be used to UV-gloss one side of an input member ($R_S'$) 567, which is a receiver member carrying a simplex color toner image. This color toner image is preferably made from conventional (non-UV-curable) color toner such that at least pictorial areas therein have a colorless UV-curable toner overlay. The color toner is preferably fused, and the colorless UV-curable toner overlay is at least tacked to the color toner, and preferably fused thereto. Input member $R_S'$ is moved along path n, into the accessory 560 and is processed by being moved through UV-glossing apparatus 561 so as to emerge from unit 560 as a simplex UV-glossed print. UVG 552 is preferably similar to apparatus 200 of FIG. 2. Similarly, an input member $R_D'$ (568) can be used. $R_D'$ carries on each face a duplex color toner image made from conventional (non-UV-curable) color toner that is preferably in a fused state (on both faces of $R_D'$), with one face only thereof having coated thereon a colorless UV-curable toner overlay that is at least tacked to the color toner, and preferably fused thereto. Input member 568 is moved into unit 560 along the path p, and through UVG 552 in manner such that the clear toner overlay faces the belt included in the UVG 561, thereby resulting in a duplex "mixed" print as the output member. In order to make a duplex UV-glossed print, an input member $R_D''$ (569) is used, as shown in FIG. 7*d*. The member $R_D''$ carries on each face a duplex color toner image made from conventional (non-UV-curable) color toner that is preferably in a fused state (on both faces of $R_D'$), with each face having coated thereon a colorless UV-curable toner overlay that is at least tacked to the respective color toner, and preferably fused thereto. Input member 569 is moved into unit 560 along the path q, and through UVG 552 so as to thereby UV-cure the colorless toner on one of the faces. The member, after emerging from the unit 560, is manually inverted and returned to unit 560 for UV-glossing of the opposite face, thereby resulting in a duplex UV-glossed print as the output member. Alternatively, the member having one face UV-glossed is moved along a path q' within the accessory 560 to a mechanism (not shown) for inverting the member, which inverted member is then moved through UVG 552 and then out of the accessory as a duplex UV-glossed print. For "near-line" operation, electronic signals (ES) are sent, e.g., from an associated electrophotographic machine wherein $R_S'$ and $R_D'$ and $R_D''$ are made, to a logic and control unit (LCU) and then to the UVG 551. These electronic signals are used to control operational setpoints in the UVG, e.g., to make adjustments to the setpoints for different types of receiver members, and so forth. With reference to FIG. 4, the accessory unit 500 can be exemplary of embodiment 560 (i.e., without a mechanical inverter for a path q').

Figure 8A:
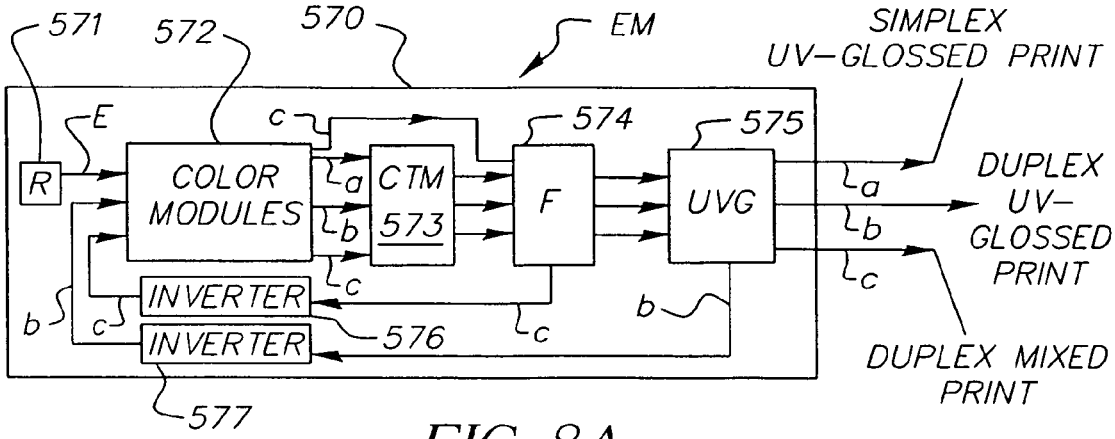
FIGS. 8*a, b, c* show block diagram sketches of certain electrophotographic reproduction apparatus embodiments which include UV-glossing apparatus of the invention.

FIGS. 8*a, b, c* show block diagrams of electrophotographic reproduction apparatus embodiments including UV-glossing apparatus of the invention for making simplex and duplex prints using clear or colorless UV-curable toner.

FIG. 8*a* illustrates an electrophotographic reproduction apparatus (EM) 570 which includes: a plurality of modules for forming conventional (non-UV-curable) color toner images (which plurality is indicated by the box 572 labeled Color Modules), a colorless toner module (CTM) 573, a conventional fusing station F (574), and a UV-glossing unit of the invention UVG (575). A receiver member R (571) is moved along path E, through the color modules 572 wherein a conventional unfused color toner image can be formed on one face of the receiver member. For simplex glossing, member 571 is then moved along path a, through CTM 573 wherein a layer of clear UV-curable toner is formed on the unfused color toner image. Member 571 is then moved to any suitable fusing station F wherein the color toner image and the overlayer of clear UV-curable toner are co-fused to member R. A resulting input member having thereon a pre-gloss toner image is thereby produced and moved through UVG 575 so as to produce an output member from machine 570 in the form of a simplex UV-glossed print. For duplex glossing, a receiver member 571 having a conventional unfused color toner image formed on one face by the color modules 572 is moved along path b, successively through CTM 573, fusing station (F) 574, and UVG 575, and from thence to an inverter mechanism 577, whereupon the inverted sheet is repassed though color modules 572, CTM 573, F 574, and UVG 575 and outputted from machine 570 as a duplex UV-glossed print. To make a "mixed" print, a receiver member 571 having a conventional unfused color toner image formed on one face is moved along path c, so as to bypass CTM 573 and then moved through fusing station 574, from which the member is moved through inverter 576. The inverted sheet is repassed though color modules 572, CTM 573, F 574, and UVG 575 and outputted from machine 570 as a "mixed" print, i.e., UV-glossed on one side only.

Figure 8B:
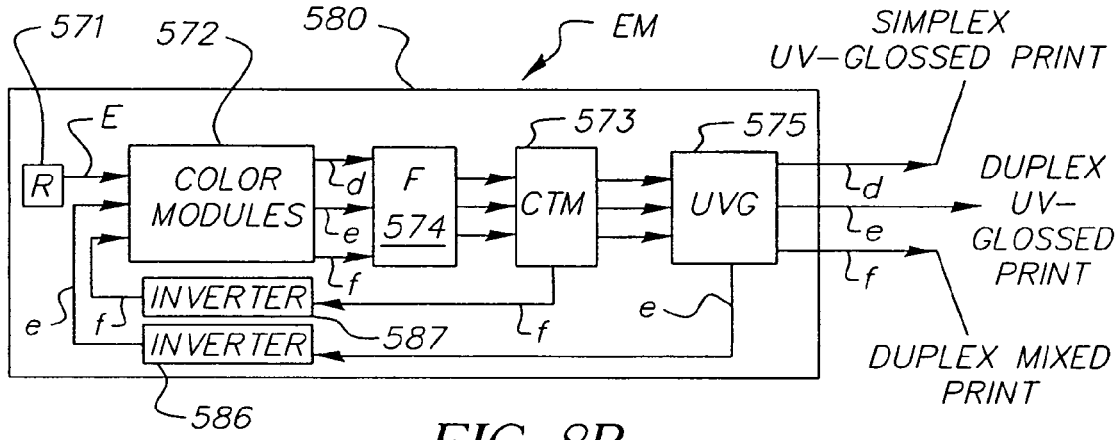

FIG. 8*b* illustrates an electrophotographic reproduction apparatus (EM) 580 which includes: a plurality of modules for forming conventional (non-UV-curable) color toner images (which plurality is indicated by the box 572 labeled Color Modules), a colorless toner module (CTM) 573, a conventional fusing station (F) 574, and a UV-glossing unit of the invention UVG (575), which elements, although ordered in a different sequence, have characteristics entirely similar to the corresponding elements similarly numbered in FIG. 8*a*. A receiver member R (571) is moved along path E, through the color modules 572 wherein a conventional unfused color toner image can be formed on one face of the receiver member. For simplex glossing, member 571 is then moved along path d, through fusing station (F) 574 wherein the color toner image is fused to R. Member 571 is then moved through CTM 573 wherein an unfused layer of clear UV-curable toner is formed on the fused color toner image. The input member having thereon a pre-gloss toner image is moved through UVG 575 so as to produce an output member from reproduction apparatus 580 in the form of a simplex UV-glossed print. For duplex glossing, a receiver member 571 having a conventional unfused color toner image formed on one face by the color modules 572 is moved along path e, successively through fusing station (F) 574, CTM 573, and UVG 575, and from thence to an inverter mechanism 586, whereupon the inverted sheet is repassed though color modules 572, (F) 574, CTM 573, and UVG 575 and outputted from machine 580 as a duplex UV-glossed print. To make a "mixed" print, a receiver member 571 having a conventional unfused color toner image formed on one face is moved along path, f, and through fusing station 574 to inverter 587. From thence the inverted sheet is repassed though color modules 572, F 574, CTM 573, and UVG 575 and outputted from machine 580 as a "mixed" print, i.e., UV-glossed on one side only.

Figure 8C:
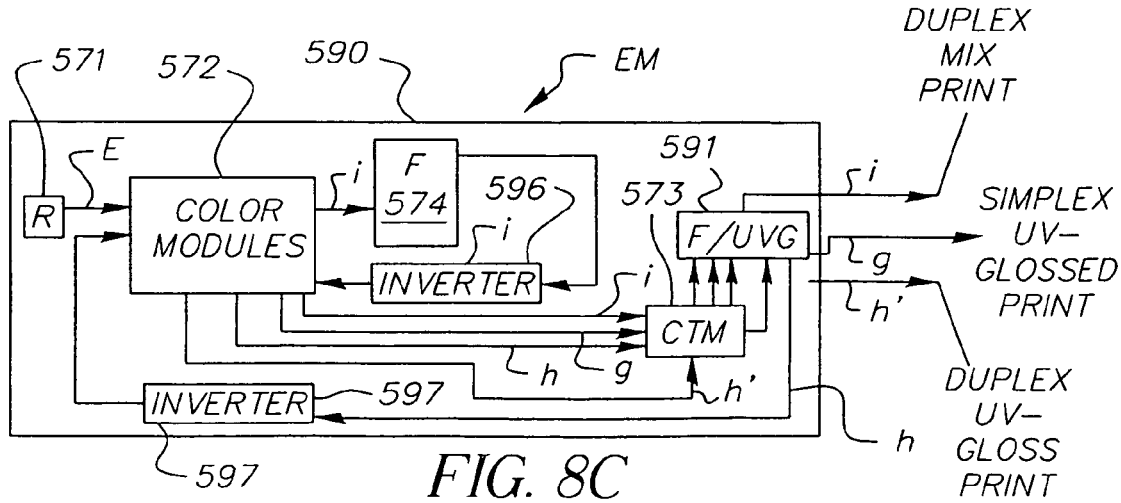

FIG. 8*c* illustrates an electrophotographic reproduction apparatus (EM) 590 which includes: a plurality of modules for forming conventional (non-UV-curable) color toner images (which plurality is indicated by the box 572 labeled Color Modules), a colorless toner module (CTM) 573, and a conventional fusing station (F) 574, which elements, although ordered differently, have characteristics entirely similar to the corresponding elements similarly numbered in FIG. 8*a*. Reproduction apparatus 590 also includes a UV-glossing unit of the invention (F/UVG) 591, in which a pre-gloss toner image is fused in a heating zone and subsequently UV-cured for glossing in an exposure zone, in manner described above. A receiver member (R) 571 is moved along path E, through the color modules 572 wherein a conventional unfused color toner image can be formed on one face of the receiver member. For simplex glossing, member 571 is then moved along path g, through fusing station (F) 574 wherein the color toner image is fused to R. Member 571 is then moved through CTM 573 wherein an unfused layer of clear UV-curable toner is formed on the fused color toner image. The input member having thereon a pre-gloss toner image is moved through (F/UVG) 591, wherein the pre-gloss toner image produced in CTM 573 is fused and UV-crosslinked so as to produce an output member from reproduction apparatus 590 in the form of a simplex UV-glossed print. For duplex glossing, a receiver member 571 having a conventional unfused color toner image formed on one face by the color modules 572 is moved along path h, successively through fusing station CTM 573 and F/UVG 591, and then to an inverter mechanism 597, whereupon the inverted sheet is repassed though color modules 572 to path h', leading to CTM 573 and F/UVG 591. The sheet is then outputted from reproduction apparatus 590 as a duplex UV-glossed print. To make a "mixed" print, a receiver member 571 having a conventional unfused color toner image formed on one face is moved along path i, and through fusing station 574 to inverter 596. The inverted sheet is then repassed though color modules 572, CTM 573, and F/UVG 591 and outputted from reproduction apparatus 590 as a "mixed" print, i.e., UV-glossed on one side only.

In further reference to FIGS. 8*a, b, c*, it will be evident that ordinary (non-glossed) simplex and duplex prints can be made in EM 570, 580, 590 via the respective fusing stations if the glossing apparatus are bypassed (paths not illustrated).

The invention has been described in detail with particular reference to certain preferred embodiments thereof, but it will be understood that variations and modifications can be effected within the spirit and scope of the invention.

The invention claimed is:

1. A method for forming a durable toner image on a face of a receiver member, said durable toner image made from a pre-gloss toner image formed from toner particles, said pre-gloss toner image having at least a portion thereof in which at least the outermost toner is made from UV-curable toner, said method further utilizing a movable receiver member transport web having a smooth surface and being transparent to UV radiation, wherein in said method an input member including said pre-gloss toner image on said receiver member is movable in non-slip association with said transport web with said outermost toner in direct contact with said smooth surface, said method including the steps of:

moving said input member with said web through a heating zone to melt toner such that at least said outermost toner is heated to a molten state;

with said molten state being maintained, moving said receiver member with said web into an exposure zone, and curing at least said outermost toner, which contacts said smooth surface of said web, in said exposure zone by exposure to a flux of UV radiation, said curing causing crosslinking of at least said outermost toner, said curing thereby forming a crosslinked fused toner image on said face of said receiver member;

moving said receiver member with said web out of said exposure zone and through a cooling zone so as to cool said crosslinked fused toner image to a temperature below a glass transition temperature of any said UV-curable toner included in said crosslinked fused toner image; and moving said receiver member with said web through a separation zone such that said receiver member, bearing said crosslinked fused toner image, is separated from said web, thereby producing an output member having said durable toner image on said face of said receiver member.

2. The method of claim 1, including the steps wherein said pre-gloss toner image is formed as a partial-page pattern of color toner formed on said face of said receiver member, and said pre-gloss toner image includes colorless UV-crosslinkable toner particles selectively deposited in juxtaposition with said partial-page pattern of color toner.

3. The method of claim 1, including the steps wherein, in forming said UV-curable toner of said pre-gloss toner image, at least one UV-curable color toner is included, and UV-curable colorless toner is excluded.

4. A method for forming durable duplex images on both sides of a receiver member, said durable duplex images made on a receiver member having thereon a durable toner image on one face thereof, and a pre-gloss toner image on the opposite face thereof, said pre-gloss toner image formed from toner particles, said pre-gloss toner image having at least a portion thereof in which at least the outermost toner is made from UV-curable toner, a transport web having a smooth surface and transparency to UV radiation, wherein an input member including said pre-gloss toner image on said receiver member is movable in non-slip association with said transport web through a plurality of processing zones, with said outermost toner in direct contact with said smooth surface of said transport web, said method including the steps of:

moving said input member with said transport web through a heating zone to melt toner such that at least said outermost toner is heated to a molten state so as to flow;

with said molten state being maintained, moving said receiver member with said transport web into an exposure zone, and curing at least said outermost toner which contacts said smooth surface of said transport web in said exposure zone by a flux of UV radiation, said molten state being maintained during said curing, said curing causing crosslinking of at least said outermost toner, thereby forming a crosslinked fused toner image on said face of said receiver member;

moving said receiver member with said transport web out of said exposure zone and through a cooling zone so as to cool said crosslinked fused toner image to a temperature below a glass transition temperature of any said UV-curable toner included in said crosslinked fused toner image; and moving said receiver member with said web through a separation zone such that said receiver member, bearing said crosslinked fused toner image, is separated from said transport web, thereby producing as an output member said durable duplex image glossed on both sides of said receiver member.

5. Glossing apparatus producing from a toner particle image receiver member an output member, said output member including a durable toner image, said glossing apparatus comprising:

a receiver member transport web movable along a transport path, said transport web having transparency to UV radiation and a smooth surface, and a surface opposite said smooth surface;

a heating zone, associated with said transport path, said heating zone including a heating mechanism having a controllable source of heat for melting at least said outermost toner of a toner image on said receiver member;

an exposure zone, associated with said transport path downstream of said heating zone, said exposure zone including of a source of UV radiation;

a cooling zone, associated with said transport path downstream of said exposure zone, said cooling zone including a cooling mechanism for cooling said transport web;

a separation zone, associated with said transport path downstream of said cooling zone, said separation zone including a separation mechanism for separating said receiver member from said transport web;

said receiver member selectively in operative engagement with said transport web such that said outermost toner of said pre-gloss toner image contacts said smooth surface of said transport web, in non-slip fashion, as said receiver member is transported by said transport web through said sequential heating, exposure, cooling, and separating process zones;

wherein: in said heating zone, at least said outermost toner in contact with said smooth surface is heated to a molten state so as to flow; in said exposure zone, said outermost toner, a flux of UV radiation is emitted by said UV radiation to crosslink at least said outermost toner, thereby forming a crosslinked fused toner image on said face of said receiver member; in said cooling zone, said crosslinked fused toner image is cooled to a temperature below a glass transition temperature of any said UV-curable toner included in said crosslinked fused toner image; and in said separating zone, said receiver member is separated from said transport web so as to result in an output member including said durable glossed toner image on said face.

6. Glossing apparatus of claim 5, wherein said movable transport web includes a rotatable closed loop belt having a smooth surface on the outside of the belt; and said smooth surface has a smoothness selected such that a gloss is imparted to said durable toner image is determined primarily by the belt smoothness.

7. Glossing apparatus of claim 6, wherein:

said belt is entrained in tension around a controllably heated roller and a steering roller, said steering roller having outer diameter smaller than outer diameter of said heated roller;

said belt is captured in a nip between said heated roller and a resilient pressure roller so as to form said heating zone inclusive of said nip, said nip having a controllable pressure; and said exposure zone and said cooling zone being located between said nip and said steering roller, said exposure zone preceding said cooling zone.

8. Glossing apparatus of claim 6, wherein said gloss imparted to said durable glossed toner image has a $G_{20}$ value equal to or greater than approximately 70.

9. Glossing apparatus of claim 8, wherein:

said belt includes a main layer comprising a polyimide material, said main layer being an inner layer coated by a protective outer layer comprising a sol-gel.

10. Glossing apparatus of claim 6, wherein:

said belt is entrained in tension around a controllably heated roller and a steering roller;

said belt is captured in a nip between said heated roller and a resilient pressure roller so as to form said heating zone inclusive of said nip, said nip having a controllable pressure;

said exposure zone and said cooling zone are sequentially located between said nip and said steering roller;

said cooling zone provides a flow of cooling air for cooling said web; and said separation zone includes a said steering roller.

11. Glossing apparatus of claim 5, wherein at least during a time period when said receiver member is within said heating zone, a pressure contact exists between said smooth surface of said transport web and said outermost toner included in said toner image.

12. Glossing apparatus of claim 5, wherein said separating mechanism, for aiding separating of said receiver member from said transport web, acts to make negligible any toner offset from said output member to said transport web.

13. Glossing apparatus of claim 12, wherein said separating mechanism includes at least one of the following separation devices: a blade, and a wedge-shaped body.

14. Glossing apparatus of claim 6, wherein said transparency allows a transmitted flux through said belt of UV radiation having a power density of at least approximately 1 Joule/$cm^2$.

15. Glossing apparatus of claim 6, wherein said cooling mechanism comprises a flow of air directed at said inside of said belt.

16. Glossing apparatus of claim 6, including a cleaning mechanism for cleaning said inside of said belt.

17. Glossing apparatus of claim 7, including a cleaning mechanism for cleaning outer surface of said pressure roller.

18. Glossing apparatus of claim 6, including a cleaning mechanism for cleaning said smooth surface on said outside of said belt.

19. Glossing apparatus of claim 6, wherein said belt is moved at a speed greater than or equal to approximately 15 cm/sec.

* * * * *